US011624147B1

(12) United States Patent
Roushall et al.

(10) Patent No.: US 11,624,147 B1
(45) Date of Patent: Apr. 11, 2023

(54) DRYING AND CURING HEATING SYSTEMS

(71) Applicant: CreateMe Technologies LLC, New York, NY (US)

(72) Inventors: Randy K. Roushall, Redwood City, CA (US); Christopher James Foster, San Francisco, CA (US)

(73) Assignee: CREATEME TECHNOLOGIES LLC., New York, NY (US)

( * ) Notice: Subject to any disclaimer, the term of this patent is extended or adjusted under 35 U.S.C. 154(b) by 0 days.

(21) Appl. No.: 17/845,612

(22) Filed: Jun. 21, 2022

(51) Int. Cl.

| | |
|---|---|
| ***D06F 71/34*** | (2006.01) |
| ***D06F 58/26*** | (2006.01) |
| ***B41M 7/00*** | (2006.01) |
| ***D06F 58/30*** | (2020.01) |

(52) U.S. Cl.
CPC ..... *D06F 71/34* (2013.01); *B41M 7/009* (2013.01); *B41M 7/0081* (2013.01); *D06F 58/26* (2013.01); *D06F 58/30* (2020.02)

(58) Field of Classification Search
CPC ..... D06F 71/34; D06F 58/26; D06F 58/30; B41M 7/0081; B41M 7/009; B41F 3/52; B41F 15/06; B41F 23/0403; B41F 23/0406; B41F 23/0413; B41J 11/0024; B41J 11/00242
USPC ..... 34/595
See application file for complete search history.

(56) References Cited

U.S. PATENT DOCUMENTS

| | | | | |
|---|---|---|---|---|
| 2,521,512 | A * | 9/1950 | Gayring | D06F 71/34 38/15 |
| 2,731,733 | A * | 1/1956 | Griner | D21F 5/00 34/146 |
| 3,785,763 | A | 1/1974 | Bratko | |
| 3,795,060 | A | 3/1974 | Jaffa et al. | |
| 4,991,506 | A | 2/1991 | Rodi | |
| 6,161,304 | A | 12/2000 | Iaccino et al. | |
| 6,562,413 | B1 | 5/2003 | Morgavi | |
| 6,699,921 | B2 | 3/2004 | Ikeda | |
| 6,857,368 | B2 | 2/2005 | Pitz | |
| 9,826,338 | B2 | 11/2017 | Pal | |
| 10,144,209 | B2 | 12/2018 | Franz et al. | |
| 10,442,183 | B2 | 10/2019 | Franz et al. | |
| 2005/0209936 | A1 | 9/2005 | Guy | |
| 2007/0193056 | A1 | 8/2007 | Switalski | |
| 2011/0102525 | A1* | 5/2011 | Larson | B41J 11/00216 347/102 |
| 2013/0215203 | A1* | 8/2013 | Chen | B41J 29/377 347/102 |
| 2021/0088490 | A1* | 3/2021 | Metcalf | B41F 33/02 |
| 2021/0155017 | A1* | 5/2021 | Sato | B41J 2/01 |

* cited by examiner

*Primary Examiner* — John P McCormack

(57) ABSTRACT

A dryer includes a pressure plate and a plurality of heating bulbs configured to emit short wave infrared radiation. A hood of the dryer is coupled to an exhaust vent and a fan. One or more sensors of the dryer measure a drying parameter corresponding to at least a portion of an article to be dried. One or more sensors in the exhaust vent monitor the air being drawn from under the hood and through the exhaust vent. A controller receives data from at least one of the sensors, and uses the data to regulate operation of each heating bulb independently of other heating bulbs of the dryer.

18 Claims, 19 Drawing Sheets

DRYING AND CURING HEATING SYSTEMS

CROSS-REFERENCE TO RELATED APPLICATIONS

This application is related to the co-pending and co-owned application titled "Drying and Curing Heating Systems," application Ser. No. 17/845,371; filed on the same date as the present application. This application is related also to the co-pending and co-owned application titled "System and Method for Thermal-Visual Servoing," application Ser. No. 17/845,668; filed on the same date as the present application, and incorporated herein by reference in its entirety.

TECHNICAL FIELD

Embodiments presented in this disclosure generally relate to apparatus, systems, and methods for drying articles, such as textiles, such as garments. Such a system can be used also for drying and curing chemicals, such as ink, that are applied to the article in a printing process.

BACKGROUND

In a Direct To Garment (DTG) printing process, a pretreatment solution is applied to at least a portion of a textile article, such as a garment, and then a design is printed in ink onto the pretreated portion. In a wet-on-wet DTG printing process, the pretreated portion is still wet when the ink is applied. Typically, a dryer dries and cures the applied ink and dries the pretreated portion simultaneously. In an wet-on-dry printing process, the pretreated portion is dried, such as by a dryer, before the ink is applied. Then a dryer dries and cures the ink. The time for drying/curing and the energy usage of a dryer depends upon aspects such as the size of the textile article, the type of fabric, the amount of pretreatment solution applied, and the amount and type of ink applied. Typically, dryers are operated for a prescribed time and heat output for each textile article. However, sometimes the drying of a textile article, or the curing of ink on the textile article, may be incomplete, and at other times a part of a textile article may be subjected to too much heat, resulting in burning of the ink and/or damage to the textile.

SUMMARY

Embodiments presented in this disclosure generally relate to apparatus, systems, and methods for drying articles, such as textiles, such as garments. In one embodiment, a method of heating and pressing an article includes positioning an article at a dryer, irradiating at least a portion of the article by actuating one or more heating bulbs of the dryer, applying pressure to the article via a pressure plate of the dryer, monitoring a parameter related to heating the portion of the article, and regulating a heat output of the one or more heating bulbs in response to monitoring the parameter.

In another embodiment, a drying apparatus includes a hood including a plurality of compartments, each compartment including a reflector, each reflector configured to direct incident radiation towards a corresponding region below the reflector. The apparatus further includes a plurality of heating bulbs configured to emit short wave infrared radiation, each heating bulb disposed in a corresponding compartment of the plurality of compartments. The apparatus further includes an exhaust vent coupled to the hood, a fan disposed in the exhaust vent, a shroud circumscribing the compartments and extending below the reflectors, a sensor configured to measure a parameter related to heating of at least a portion of an article located below the hood, and a pressure plate disposed below the plurality of heating bulbs.

In another embodiment, a drying apparatus includes a pressure plate assembly and a bulb array. The pressure plate assembly includes a first hood, an exhaust vent coupled to the first hood, a fan disposed in the exhaust vent, a sensor configured to measure a parameter related to heating of at least a portion of an article located below the first hood, and a pressure plate coupled to the first hood and disposed below the exhaust vent. The bulb array includes a second hood including a plurality of compartments, each compartment including a reflector, a shroud circumscribing the compartments and extending below the reflectors, and a plurality of heating bulbs configured to emit short wave infrared radiation, each heating bulb disposed in a corresponding compartment of the plurality of compartments.

BRIEF DESCRIPTION OF THE DRAWINGS

So that the manner in which the above recited aspects are attained and can be understood in detail, a more particular description of embodiments described herein, briefly summarized above, may be had by reference to the appended drawings.

It is to be noted, however, that the appended drawings illustrate typical embodiments and are therefore not to be considered limiting; other equally effective embodiments are contemplated.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure generally relate to apparatus, systems, and methods for drying articles, such as textiles, such as garments. The apparatus, systems, and methods can be used also for drying and curing chemicals, such as ink, that are applied to the article in a printing process. The apparatus includes heating bulbs, such as infrared (IR) heating bulbs, such as short wave infrared (SWIR) heating bulbs. The heating bulbs can be controlled independently of each other. A heat output of a heating bulb can be varied while an article is being dried. One or more sensors monitor the drying of the article, and provide feedback to a dryer controller. The dryer controller regulates the heat output of a heating bulb in response to the feedback.

While the discussion below describes apparatus and operations concerning the drying of a garment (e.g., an item of clothing) that has been subjected to one or more DTG printing operation, the embodiments herein can be used for various "articles" which can include, but are not limited to, an item of clothing (e.g. shirts, pants, socks, shoes, shorts, coats, jackets, skirts, dresses, underwear, hats, headbands, and the like), accessories (e.g. wallets, purses, and the like), and homewares (e.g. artwork, upholstery, towels, bed linens, blankets, mats, and the like).

Figure 1:
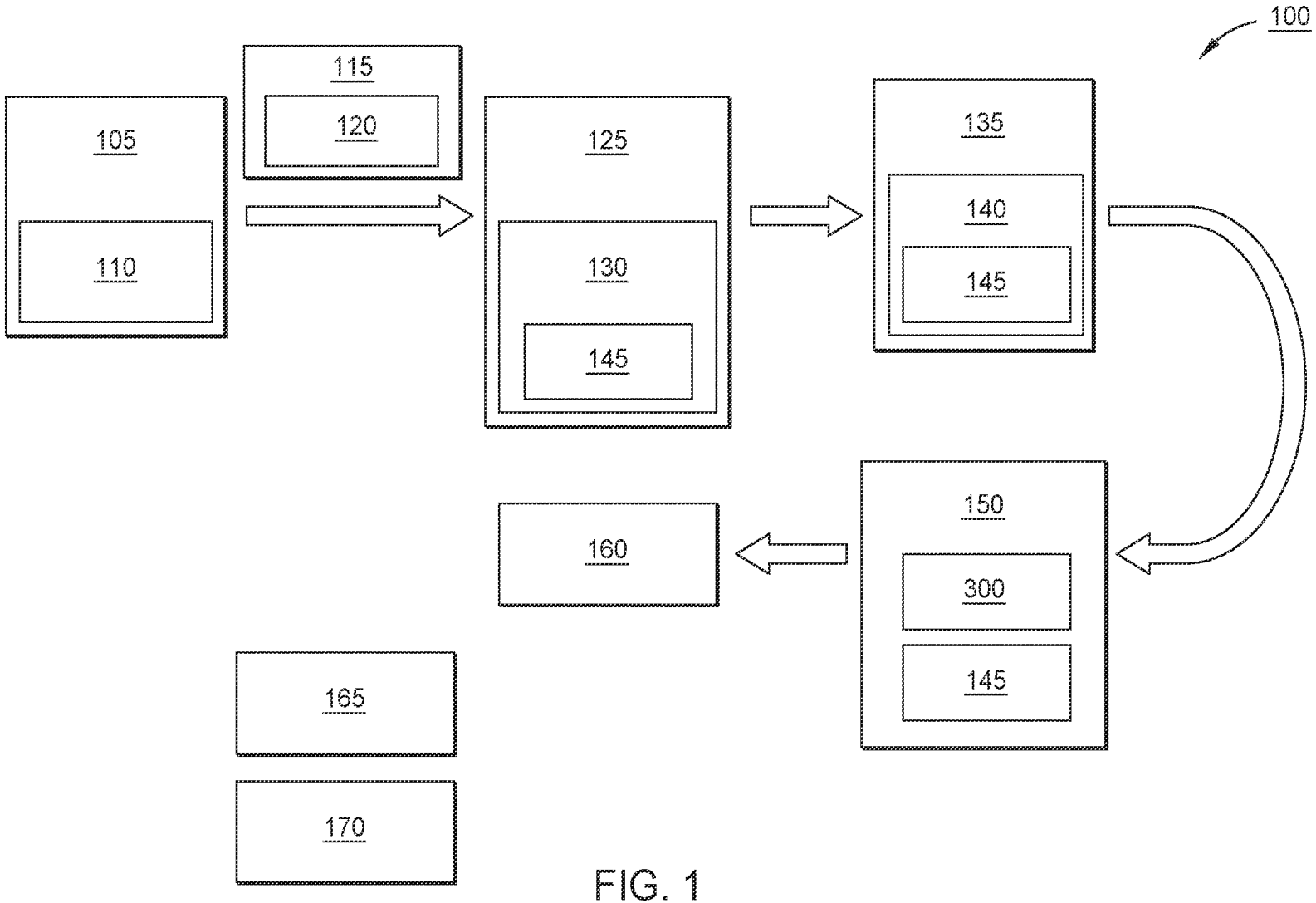
FIG. 1 is a block diagram of a DTG printing environment.

FIG. 1 is a block diagram of a DTG printing system 100, according to one embodiment. Unlike a serialized DTG printing process which may rely on a track or a conveyor belt to iteratively move a garment through different DTG processing stages, the DTG printing system 100 relies on autonomous robots 115 to move garments 120 between at least two different stations. As used herein, "autonomous robots" include any robot that can navigate an environment without human guidance or intervention. An autonomous robot can be fully autonomous (i.e., operate without receiving navigation commands from any external entity, whether human or a software application) or partially autonomous where the robot receives navigational commands (e.g., step-by-step directions or routes) from an external non-human controller (e.g., a control tower). However, in some embodiments tracks or conveyor belts can also be used to move the garments 120 between some stations, or between different locations in the same station, to result in a hybrid approach where the robots 115 are used to move the garments 120 between some stations, while other means are used to move the garments 120 between other stations.

The DTG printing system 100 includes a primary controller 165 and a secondary controller 170 for controlling the movement of the robots 115 through the environment. These controllers 165, 170 may be software applications stored in memory and executed using one or more processors in a computing system. In one embodiment, the primary controller 165 monitors the various stations in the system 100 to determine which ones are currently occupied and which ones are available (or are about to become available). With this information, the primary controller 165 can decide which station to process which job and in what sequence. In one embodiment, the primary controller 165 commands the secondary controller 170 to supply a particular garment to a particular station. In some embodiments, stationary robot arms (not shown) may move the garments 120 between stations.

The secondary controller 170 can manage traffic in the DTG printing system 100 by managing the routes the robots 115 take when moving between stations. The secondary controller 170 receives the commands from the primary controller 165 and determines routes for the robots 115 so the commands are fulfilled. For example, the robots 115 may follow markers disposed on the floor of the environment (e.g., a warehouse) such as a grid of intersecting lines. The secondary controller 170 can provide instructions to the robots 115 for navigating the grid to move from its current location to the location of the next station that was selected by the primary controller 165. The secondary controller 170 can monitor the location of all the robots 115 in the environment and ensure their paths do not cause a collision. For example, if the routes for two robots 115 intersect, the secondary controller 170 may instruct one robot 115 to pause to permit the other robot to pass before permitting the robot to continue along its path. In this embodiment, the primary controller 165 selects the destinations (e.g., stations) for the robots 115 while the secondary controller 170 controls the lower-level route planning and navigation in order to move the robot 115 to those destinations. However, this is just one example. In yet another example, the robots 115 may be permitted to select their own routes between destinations selected by the primary controller 165. In that example, each robot 115 may include navigation sensors to determine the location of the robot in the environment, and may include proximity sensors that detect a nearby presence of an object in order to prevent collisions with objects, such as another robot 115. In one embodiment, the environment can include intersection signals to provide guidance to the robots 115 to find their way from one station to the next. For example, red, green, and yellow lights can be used to communicate left, right, and straight commands. In another embodiment, the environment can include small displays used to display at an intersection a specific QR code that provides the necessary instruction for the robot that reads the QR code at the intersection.

In some embodiments, the system 100 includes garment retrieval stations 105 that each include a retrieval apparatus 110 that can mount the garment 120 onto a respective robot 115. The retrieval apparatus 110 can be any machine that can pick up a garment 120, and mount or place the garment 120 on the robot 115. In some embodiments, instead of using a retrieval apparatus 110, a human could pick and place the garments 120 on the robots 115.

While the embodiments below discuss the mounting of a single garment 120 onto each robot 115, in some embodiments, multiple garments 120 are mounted on the same robot 115. Each garment 120 so mounted may be processed in parallel or iteratively at the different stations.

After retrieving a garment 120, the robots 115 proceed to one of the pretreatment stations 125. These stations 125 include a pretreatment apparatus 130 for applying a pretreatment solution to the garment 120. The pretreatment apparatus 130 can apply the pretreatment solution to an entire side of the garment 120 or only to a portion on which a design is to be printed. In an example, the printed image may cover only a small portion of a T-shirt rather than the entire side of the T-shirt, and an extent of the pre-treated portion of the T-shirt may be configured accordingly. The embodiments herein are not limited to any particular type of pretreatment apparatus 130.

After the pretreatment solution is applied, the robots 115 move the garments 120 to one of the DTG printing stations 135 where an image is printed on the garments 120. In an example, the system 100 uses a wet-on-wet DTG printing process in which an image is printed onto the wet pretreated area of the garment 120. However, the embodiments herein can also be used in a wet-on-dry DTG printing process in which the pretreated area of the garment 120 is first dried (such as at a drying station) before the image is printed onto the garment 120. In some embodiments, depending on such aspects as the composition of the fabric, the complexity of the art work, or requirements of the job, other methods for processing and printing on garments may be used such as screen printing or dye sublimation. In some embodiments, the system 100 may include one or more printing stations, each printing station using a different garment processing and printing method. In some embodiments, after an initial DTG printing is complete, the garment 120 may be subjected to an embellishing step such as embroidery, the application of a trim or a decorative piece, or other embellishments. In some embodiments, an embellishment is first performed before DTG printing.

The DTG printing stations 135 include DTG printers 140 that use printheads (e.g., inkjet printheads) to print designs, such as images, on the garments 120. In some embodiments, the DTG printers print designs onto the area, or areas, of the garments 120 that have been pretreated. The embodiments herein are not limited to any particular type of DTG printer 140. In some embodiments, the DTG printer 140 has a printhead that moves in one or more axes (e.g., X and Y directions in a plane parallel to the ground). That is, the garment 120 may be held in a fixed position while the printhead moves in the X and Y directions to print the design. Keeping the garment 120 fixed while moving the printhead facilitates use of a simple lift for raising and leveling the garment relative to the printhead, rather than a more complex system that involves precisely controlling a position of the carrier while the carrier is moved laterally when performing printing. Nevertheless, in some embodiments, the garment 120 may be moved during the printing while the printhead is held in a fixed position.

The DTG printers 140 can include respective lifts 145 for aligning the garments 140 carried by the robots 115 with the printhead of the DTG printers 140. In one embodiment, the lifts 145 remove a detachable carrier from the robots 115 on which the garment is mounted and aligns the detachable carrier with the printhead. Alternatively, the lift 145 may raise and align the entire robot 115 with the printhead. In yet another embodiment, the lift 145 may lower or raise the DTG printer 140 for alignment with the garment 120 on the robot 115, while the robot 115 remains in a fixed location.

Lifts 145 may be used also at other stations. In an example, lifting the garments 120 away from the robots 115 at the pretreatment stations 125 mitigates against inadvertent contact of the pretreatment solution onto the robot 115. In another example, lifting the garments 120 away from the robots 115 at the drying stations 150 mitigates against exposing the robots 115 to excessive heat. One example implementation of the lift 145 at a drying station 150 is discussed in FIGS. 6A-6F.

The same or different types of lifts may be used at various stations in the system 100 in order to change the spatial relationship between the apparatus at those stations and the garments 120. In some embodiments, lifts may be omitted from one or more stations, such as the pretreatment station 125, the printing station 135, or the drying station 150 (described below). In some embodiments, each operating station such as the pretreatment station 125 or the DTG printing station 135 may be fully or partially sealed from its surroundings. In some embodiments, each operating station may be vented to the outside so as to carry any fumes, odors or volatile chemicals to an exhaust processing system. In some embodiments, lifting the carrier to its resting position at an operating station provides the sealing function that isolates the operating station from the rest of the system 100 during operation.

After the printing operation, robots 115 move each garment 120 to a drying station 150 which includes a dryer 300. In embodiments in which the design is applied by a wet-on-wet DTG printing process, the dryer 300 helps cure the ink by drying the pretreatment solution and the ink applied by the DTG printer 140. In embodiments in which the design is applied by a wet-on-dry process, the dryer 300 is used only to dry the ink, since the pretreatment solution would have been dried at an earlier drying stage. In some embodiments, the drying stations may include one or more types of dryers, including forced air or convection dryers, radiation dryers, UV light dryers and ultrasonic dryers.

The robots 115 then move the garments 120 to packaging stations 160 where the garments 120 are removed from the robot 115, folded, and placed in containers (e.g., boxes or padded envelopes) to be shipped. The various operations performed at the packaging station 160 may be performed by machines, humans, or a combination of both.

The number of stations at each processing stage in the system 100 may vary. For example, the system 100 may include more stations for processing stages that require more time, but fewer stations for processing stages that take less time. For example, if printing requires more time than pretreatment, the system 100 may have more printers 140 than pretreatment apparatuses 130. In such an example, an overall throughput of the system 100 may be greater than a throughput of a system that includes an equal number of stations for each processing stage. In some embodiments, processing stages of the system 100 are modular, and the number of each station may be added or subtracted, as the throughput requirements of system 100 changes.

While not shown in FIG. 1, the DTG printing system 100 can include one or more inspection stages. For example, a first inspection stage may be between the garment retrieval stations 105 and the pretreatment stations 125 to ensure the garments 120 were properly loaded onto the robot 115 and there are no wrinkles in the garments 120, which can result in a low quality DTG image or clogging of the printing nozzles. A second inspection stage may be between the DTG printing stations 135 and the drying stations 150 to ensure the DTG image appears correct (such as to verify color quality, line sharpness, image alignment, that the correct has been applied to the right T-shirt, and other aspects). A third inspection stage may be between the drying stations 150 and the packaging stations 160 to verify that the drying process did not cause any smearing of, or other detrimental effect to, the image. Any of such first, second, or third inspection stages can use computer vision systems (such as automated optical inspection (AOI)) that include cameras attached to a computer vision application that uses artificial intelligence to detect wrinkles, image defects, and other detrimental anomalies. Additionally or alternatively, inspection tasks at the inspection stages can be performed by human inspectors or a combination of computer-based and human inspection.

Figure 2:
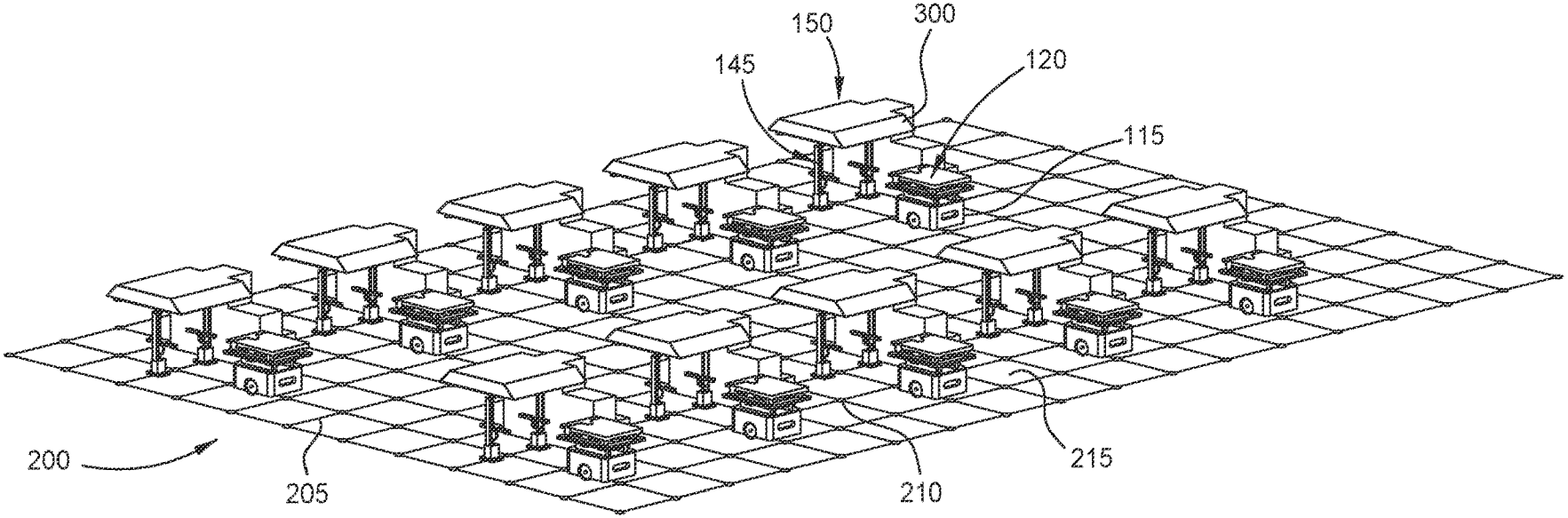
FIG. 2 schematically illustrates an aspect of the DTG printing environment of FIG. 1.

FIG. 2 schematically illustrates autonomous robots 115 delivering garments to drying stations 150, according to some embodiments. Each drying station 150 includes a dryer 300. As shown, a floor 200 of the environment containing the drying stations 150 includes a grid 205 formed by intersecting lines. As illustrated, the intersecting lines are perpendicular to each other. However, in some embodiments, at least some of the intersecting lines may not be perpendicular to each other. The grid 205 can be formed by paint or tape applied to the floor, or formed by tiles that incorporate a design including a line and/or an intersection of lines. In some embodiments, the grid is formed by grooves in between tiles 215 forming the floor. Moreover, a fiducial 210 (such as a QR code) is disposed at each intersection of the grid lines. The robots 115 include sensors, such as cameras, with fields of views that include the floor 200. The sensors detect the grid 205 and the fiducials 210. The robots 115 can use the grid 205 to navigate the floor 200 in order to travel between and within the different stations (not shown).

The fiducials 210 provide location information to the robots 115, and the robots 115 can report the location information to a controller (such as the primary or secondary controllers discussed in FIG. 1). Each fiducial 210 may be assigned a different or unique code such that each fiducial 210 occupies a unique location on the floor 200 and includes an identifier of the unique location. When the robot 115 detects a fiducial 210 and reports the code of the fiducial 210 to the controller, the controller then knows the location of the robot 115 on the floor 200. The controller then can give an instruction to the robot 115 in order to navigate to its destination (such as go straight, turn left at the intersection, or turn right at the intersection). As the robot 115 encounters a new fiducial 210, the controller can provide an updated instruction to the robot 115 until the robot 115 reaches the intended destination (such as a drying station 150 or other station on the floor 200). In some embodiments, other types of fiducials may be used. For example, signal lights of different colors may be used to communicate the next navigation instruction. In some embodiments, sensors including magnetic or optical sensors at intersections may be used to detect the robot's location and accordingly provide the next navigation instruction.

However, using the grid 205 and fiducials 210 to enable the robots 115 to traverse the floor 200 is just one example. In some embodiments, the robots 115 may include location sensors such as range finders, depth sensors, GPS receivers, and the like that enable the robots 115 to identify their location(s) and to move about the floor 200 without the aid of any markers or fiducials on the floor 200. Further, the robots 115 may not receive step-by-step instructions from a controller, but rather receive destination information from the controller, and then use a navigation aid, such as an internally saved map of the floor 200, in combination with known locations of the robots 115 to navigate to the destination.

In the illustrated example, the robots 115 drive the garments 120 underneath a portion of a dryer 300. The lift 145 then raises the garment 120 up to align it with a hood of the dryer 300. As described above, the lift 145 can raise a detachable carrier holding the garment (as is the case in FIGS. 6A-6F) or could raise the entire robot 115. Alternatively, instead of raising the garment 120, the lift 145 may be integrated into the dryer 300 in order to lower the hood of the dryer 300 until the hood is positioned at a desired location with respect to the garment 120. However, the garment 120 may not be level with the ground when deposited on the robot 115 (due to unevenness of the floor 200 or manufacturing tolerances of the robot 115). The drying station 150 may include a leveling apparatus on which the robot 115 sits when positioned underneath the hood of the dryer 300. In an example, the leveling apparatus can tilt the robot 115, which in turn can level the garment with the hood before drying, thereby compensating for unevenness in the floor 200 or manufacturing tolerances of the robot 115.

Figure 3A:
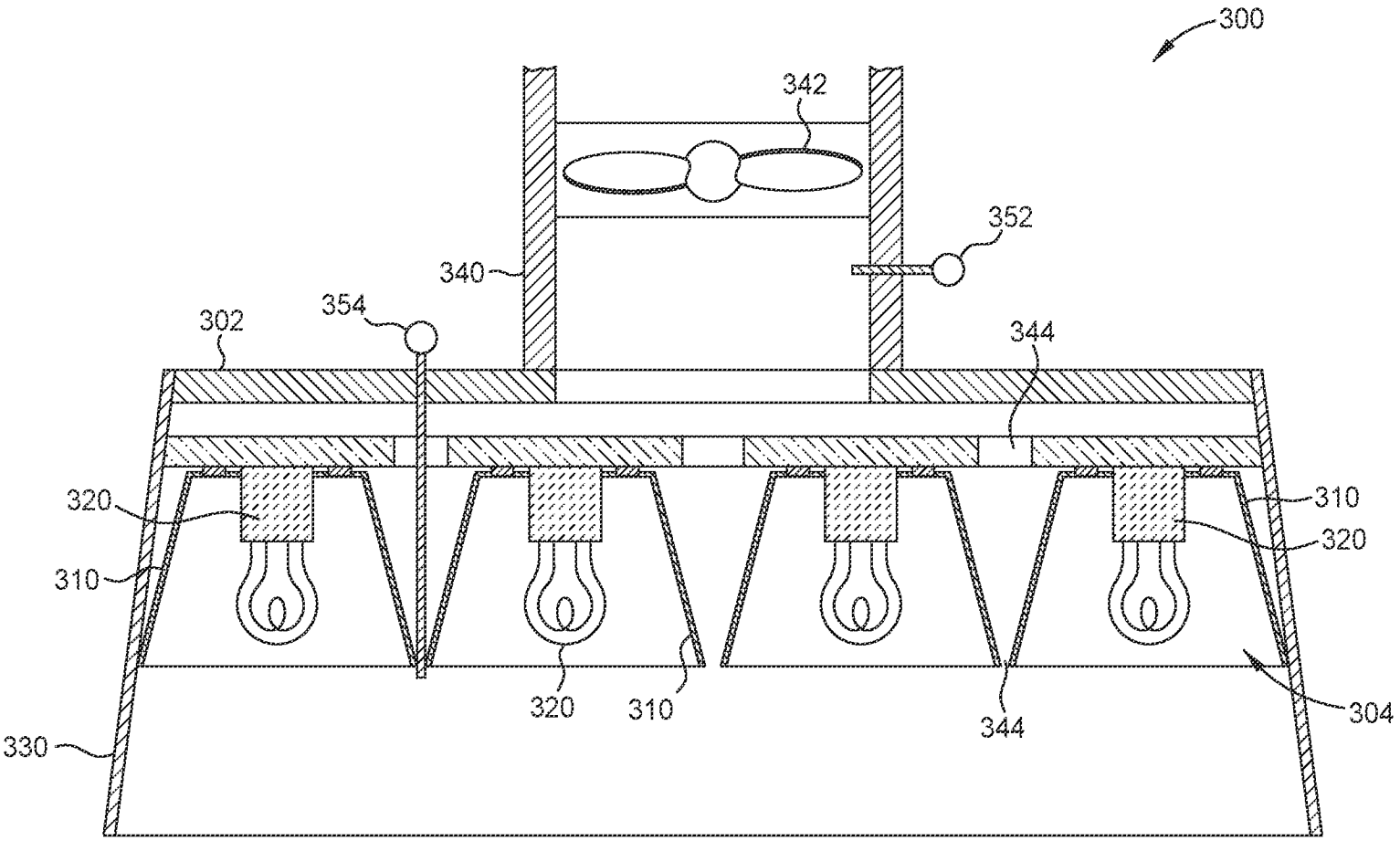
FIGS. 3A-3H schematically illustrate a dryer of the DTG printing environment of FIG. 1.
Figure 3C:
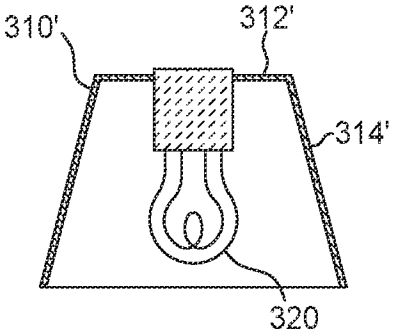
Figure 3D:
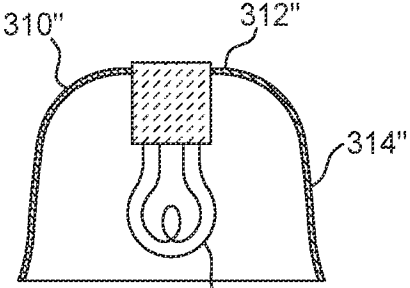
Figure 3B:
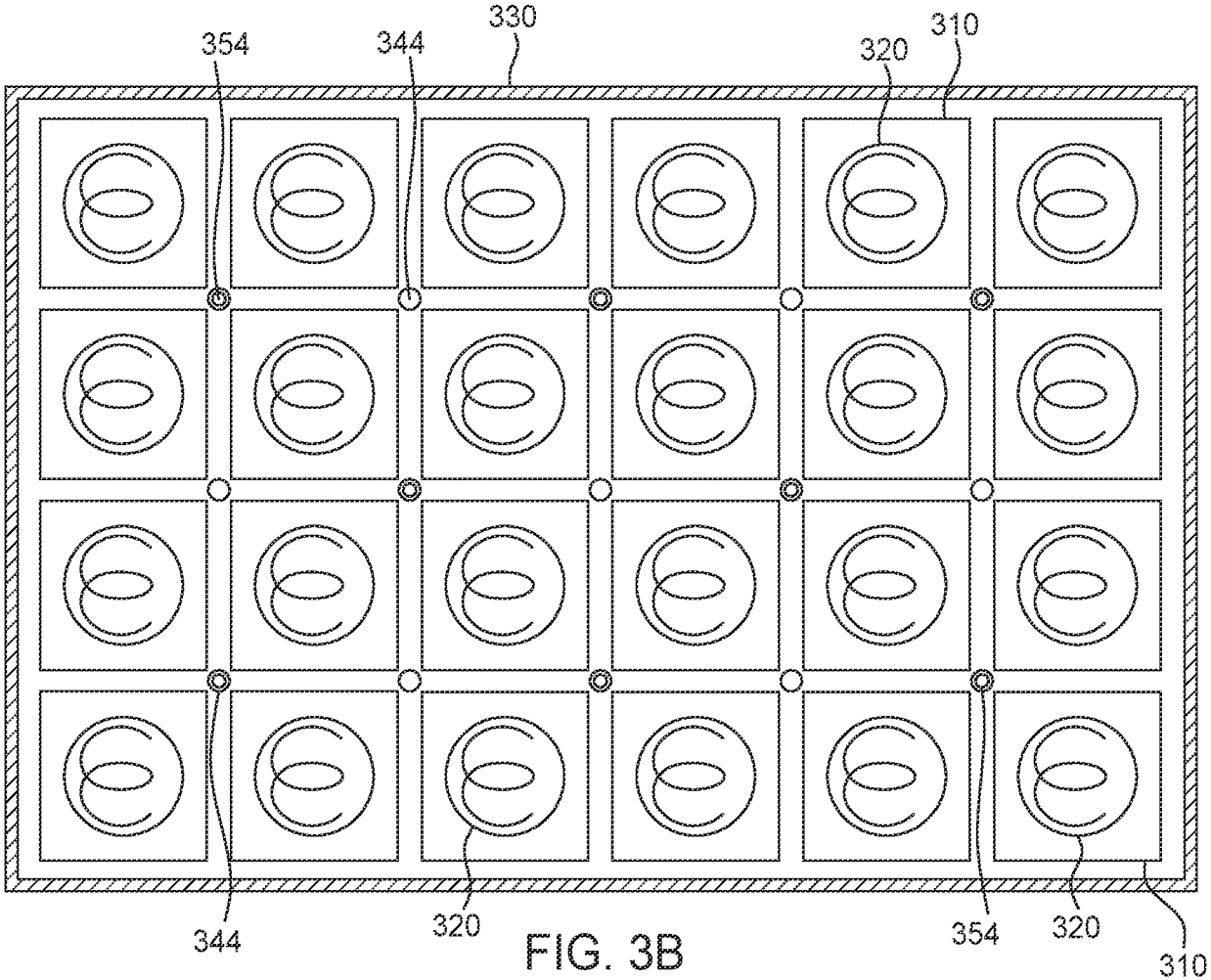

FIGS. 3A-3H schematically illustrate aspects of a dryer 300. FIG. 3A is a cross-sectional elevation, and FIG. 3B is a view from below. The dryer 300 includes a hood 302 with a plurality of compartments 304. Each compartment 304 includes a reflector 310 that is configured to direct incident radiation, such as optical light, UV light, and/or IR light, towards a corresponding region, such as below the reflector 310. A heating bulb 320 is disposed in each compartment 304. In some embodiments, the heating bulb 320 is configured to emit IR radiation, such as long wave, medium wave, and/or short wave IR radiation. In some embodiments, the heating bulb 320 is configured to emit near IR radiation. A shroud 330 circumscribes the reflectors 310, and extends below the reflectors 310.

It should be noted that the numbers and arrangements of compartments 304 and heating bulbs 320 depicted in the Figures are purely for illustrative purposes. For example, in some embodiments, the compartments 304 and heating bulbs 320 may be arranged such that each successive row of compartments 304 and heating bulbs 320 is offset from the previous row. Additionally, or alternatively, the compartments 304 and heating bulbs 320 may be arranged such that the heating bulbs 320 are more closely spaced in some areas of the hood 302 than in other areas of the hood 302.

An exhaust vent 340 is coupled to the hood 302. A fan 342 disposed in the exhaust vent 340 is configured to draw air through the hood 302, such as via apertures 344, and expel the air through the exhaust vent 340. One or more sensors 352 disposed in the exhaust vent 340 are configured to measure one or more parameters related to the garment being dried by the dryer 300, such as one or more parameters of the air in the exhaust vent 340. In an example, the one or more sensors 352 are configured to measure any one or more of temperature, pressure, flow rate, or humidity. In another example, the one or more sensors 352 include an optical or IR sensor configured to measure a quantity of one or more chemicals present in the air, such as carbon dioxide, carbon monoxide, nitrogen oxides, and/or volatile organic compounds. In another example, the one or more sensors 352 include a particle sensor, such as an optical or IR sensor, configured to measure a quantity of particulate material present in the air. In some embodiments, the one or more sensors 352 are configured to measure a combination of any two or more of the above parameters.

One or more sensors 354 are disposed in the hood 302, and are configured to measure a parameter related to the garment being dried by the dryer 300. In an example, the one or more sensors 354 include a thermal imaging camera configured to measure a temperature of a portion of the garment being dried. In another example, the one or more sensors 354 include a moisture sensor, such as an optical sensor, configured to measure a moisture content of air above a corresponding portion of the garment being dried. In another example, the one or more sensors 354 include a moisture sensor, such as an optical sensor or an IR moisture sensor, configured to measure a moisture content of a portion of the garment being dried. In some embodiments, a plurality of sensors 354 is disposed in the hood 302, the plurality of sensors 354 including one or more sensors 354 configured to measure one of the above parameters, and including one or more sensors 354 configured to measure a different one of the above parameters.

In some embodiments, data from the one or more sensors 352 and/or data from the one or more sensors 354 is used in controlling the operation of the dryer 300 by performing one or more of the methods described in the present disclosure. In some embodiments, data from the one or more sensors 352 and/or data from the one or more sensors 354 is used in controlling the operation of the dryer 300 by performing one or more of the methods described in the co-pending and co-owned application titled "System and Method for Thermal-Visual Servoing," Ser. No. 17/845,668, referenced above.

FIGS. 3C and 3D are schematic cross-sectional illustrations of example configurations of the reflectors 310. In FIG. 3C, the reflector 310' surrounds at least a portion of the heating bulb 320. The reflector 310' includes a base 312' and a sidewall 314' extending from the base 312' at an obtuse angle. In some embodiments, the sidewall 314' describes a conical shape. In some embodiments, the sidewall 314' includes a flat surface, and the reflector 310' includes several sidewalls 314' (such as three, four, or more) and describes a truncated pyramidal shape.

In FIG. 3D, the reflector 310" surrounds at least a portion of the heating bulb 320. The reflector 310" includes a base 312" and a sidewall 314" extending from the base 312". The sidewall 314" includes a surface that is curved in a plane perpendicular to the base 312". In some embodiments, the surface includes a parabolic shape. In some embodiments, the surface includes a hyperbolic shape. In some embodiments, the sidewall includes a flat surface and a surface that is curved in a plane perpendicular to the base 312".

Figure 3E:
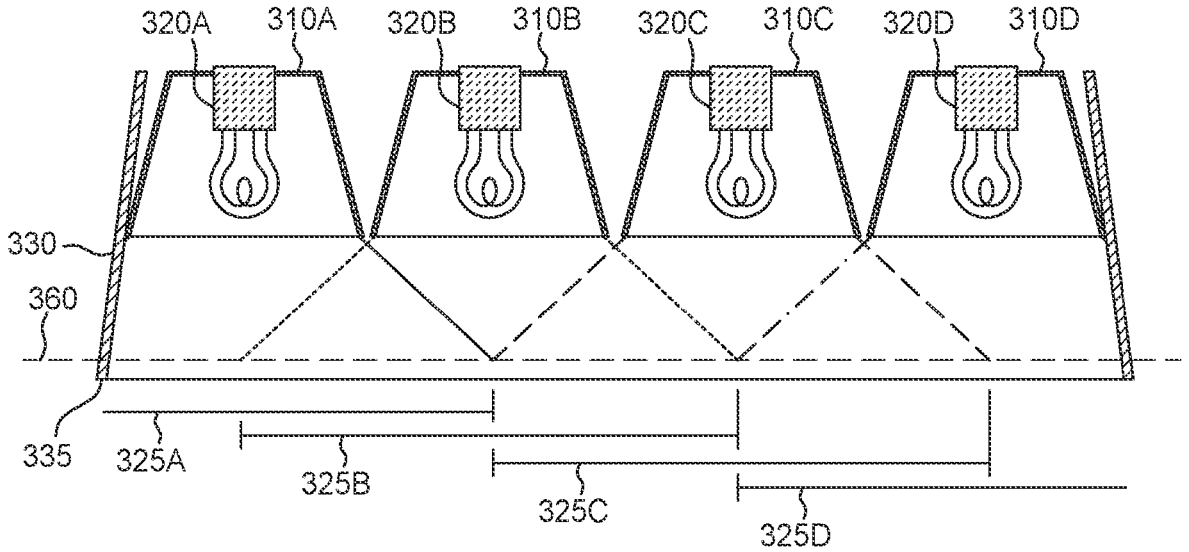
Figure 3F:
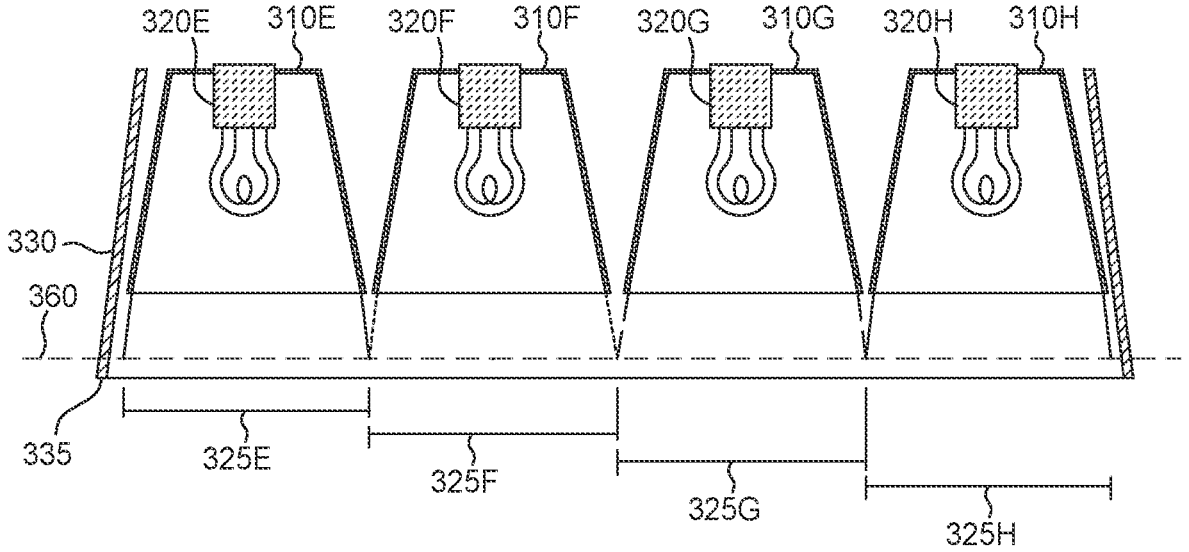

FIGS. 3E and 3F are schematic cross-sectional illustrations of example lighting configurations. FIG. 3E illustrates heating bulbs 320A, 320B, 320C, 320D and corresponding reflectors 310A, 310B, 310C, 310D. Each pairing of a heating bulb 320A/B/C/D and a corresponding reflector 310A/B/C/D is configured to irradiate a specific area below. The dryer 300 is configured such that a garment to be dried is to be located at a nominal elevation 360 within the hood 302. In the illustrated example, the nominal elevation 360 is between the reflectors 310A/B/C/D and a lower end 335 of the shroud 330. The area irradiated by each heating bulb 320A/B/C/D is represented by lines 325A, 325B, 325C, 325D, respectively.

In some embodiments, the area 325A/B/C/D irradiated by each heating bulb 320A/B/C/D may overlap with the area irradiated by a neighboring heating bulb. For example, at the nominal elevation 360 of a garment, the area 325B irradiated by heating bulb 320B overlaps with the area 325A irradiated by heating bulb 320A and the area 325C irradiated by heating bulb 320C. It is contemplated that the degree of overlap may be varied, such as by an appropriate selection of heating bulb 320A/B/C/D and/or reflector 310A/B/C/D. In some embodiments, the degree of overlap may be varied from a maximum level all the way to zero overlap. In some embodiments, the location neighboring heating bulbs 320A/B/C/D may be adjusted manually or automatically, to increase or decrease any radiation overlap between adjacent heating bulbs 320A/B/C/D. In some embodiments, the heating bulb reflectors 310E, 310F, 310G, 310H may be adjusted manually or automatically to adjust the extent of the radiation coverage of each heating bulb. In the illustrated example, in the cross-sectional plane of FIG. 3E, one half of the area 325B irradiated by heating bulb 320B overlaps with the area 325A irradiated by heating bulb 320A and the other half of the area 325B irradiated by heating bulb 320B overlaps with the area 325C irradiated by heating bulb 320C. It is contemplated that selecting a degree of heating area overlap between adjacent heating bulbs 320, and/or selecting or regulating a heat output of each heating bulb 320, facilitates the tuning of an intensity of radiation delivered to specific locations of a garment.

FIG. 3F illustrates heating bulbs 320E, 320F, 320G, 320H and corresponding reflectors 310E, 310F, 310G, 310H. Each pairing of a 320E/F/G/H and a corresponding reflector 310E/F/G/H is configured to irradiate a specific area below. As in the previous example shown in FIG. 3E, the nominal elevation 360 of a garment to be dried is between the reflectors 310E/F/G/H and the lower end 335 of the shroud 330. The area irradiated by each heating bulb is represented by lines 325E, 325F, 325G, 325H, respectively.

In this example, the area 325E/F/G/H irradiated by each heating bulb 320E/F/G/H does not overlap with the area irradiated by a neighboring heating bulb in the cross-sectional plane of FIG. 3F. Additionally, the illustrated example shows that the area 325F irradiated by heating bulb 320F abuts the area 325E irradiated by heating bulb 320E and abuts the area 325G irradiated by heating bulb 320G. In some embodiments, the area 325E/F/G/H irradiated by a heating bulb 320E/F/G/H may not abut or overlap the area irradiated by a neighboring heating bulb, and/or may not abut or overlap the area irradiated by another neighboring heating bulb. In some embodiments, the area 325E/F/G/H irradiated by a heating bulb 320E/F/G/H may overlap the area irradiated by a neighboring heating bulb, but may not overlap the area irradiated by another neighboring heating bulb.

Figure 3G:
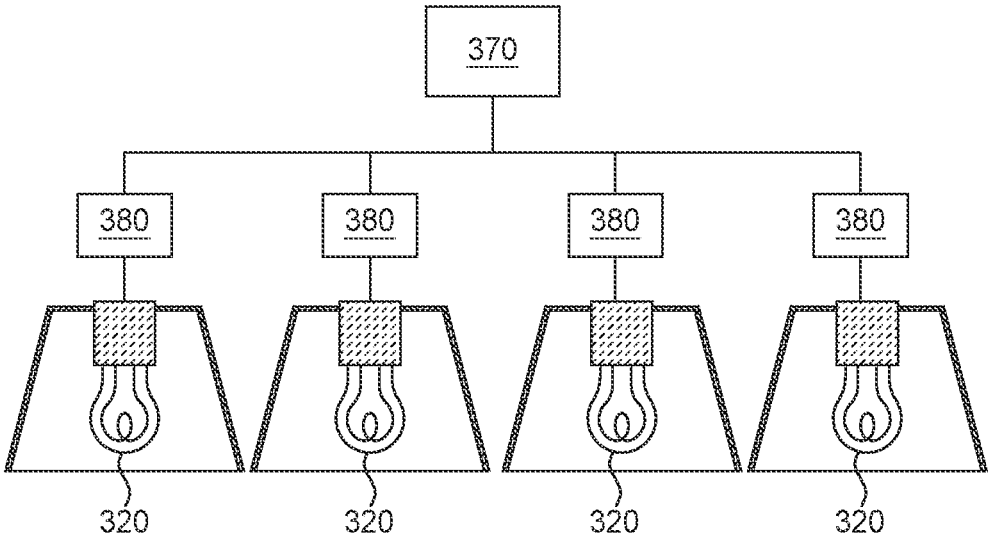

FIG. 3G schematically illustrates an arrangement for controlling the heating bulbs 320. The operation of each heating bulb 320 is controlled by a dryer controller 370. The dryer controller 370 may be the primary controller 165, a module of the primary controller 165, the secondary controller 170, a module of the secondary controller 170, or a separate controller. The dryer controller 370 switches each heating bulb 320 on or off via a corresponding switch 380, such as a relay, such as a solid state relay. In some embodiments, at least one switch 380 is paired with a single heating bulb 320 in a one-to-one correlation. In some embodiments, at least one switch 380 is paired with more than one heating bulb 320, such that two or more heating bulbs 320 may be actuated via a single switch 380. In some embodiments, at least one heating bulb 320 is paired with more than one switch 380, such that the at least one heating bulb 320 may be actuated via any of two or more switches 380.

The dryer controller 370 regulates a heat output of each heating bulb 320 independently of the heat outputs of the other heating bulbs 320. The regulating of a heat output of a heating bulb 320 includes switching the heating bulb 320 on or off. In some embodiments, the regulating of a heat output of a heating bulb 320 includes switching the heating bulb 320 on at a preset level of heat output (such as 25% power, 50% power, 75% power, or 100% power), and thereafter not altering the level of heat output of the heating bulb 320 until switching the heating bulb 320 off. In some embodiments, the regulating of a heat output of a heating bulb 320 includes altering the heat output to a preset level (such as to 25% power, 50% power, 75% power, or 100% power) after the heating bulb 320 has been switched on. In some embodiments, the regulating of a heat output of a heating bulb 320 includes varying the heat output to any value from zero to 100% power after the heating bulb 320 has been switched on. In some embodiments, the variation of the heat output of a heating bulb 320 may be adjusted during a drying/curing cycle based on one or more of the processes described in the co-pending, co-owned and related application titled "System and Method for Thermal-Visual Servoing," Ser. No. 17/845,668, referenced above.

Figure 3H:
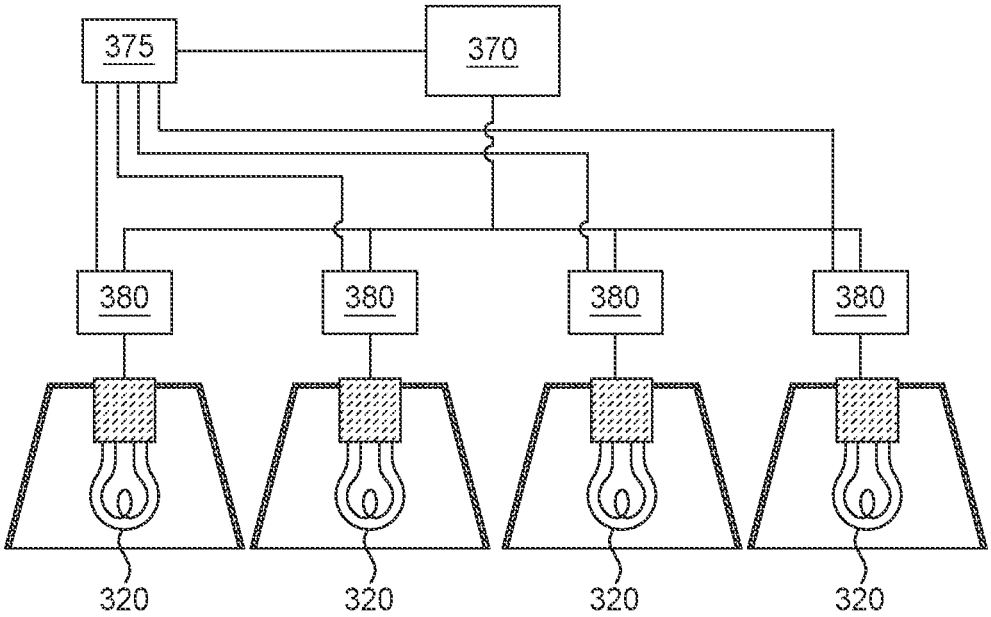

FIG. 3H schematically illustrates an arrangement for controlling the heating bulbs 320. One or more heating bulbs 320 are coupled to a local controller 375. Each local controller 375 may be associated with, and may be programmed to control, a corresponding single heating bulb 320 or a corresponding group of heating bulbs 320. In an example, each local controller 375 includes an application-specific integrated circuit (ASIC).

In some embodiments, the local controller 375 receives commands from the dryer controller 370. It is contemplated that the commands may be in the form of a signal that is addressed to correspond to a specific heating bulb 320. Each local controller 375 is programmed to recognize command signals addressed to correspond to heating bulbs 320 under the purview of the local controller 375, and controls the heating bulbs 320 according to the commands received. In some embodiments, each local controller 375 is programmed to ignore command signals that are not addressed to correspond to any of the heating bulbs 320 under the purview of the local controller 375.

As illustrated, in some embodiments, each local controller 375 actuates each heating bulb 320 via the corresponding switch 380. In some embodiments, the corresponding switch 380 for each heating bulb 320 is integrated into the corresponding local controller 375. In some embodiments, at least one switch 380 is paired with a single heating bulb 320 in a one-to-one correlation. In some embodiments, at least one switch 380 is paired with more than one heating bulb 320, such that two or more heating bulbs 320 may be actuated via a single switch 380. In some embodiments, at least one heating bulb 320 is paired with more than one switch 380, such that the at least one heating bulb 380 may be actuated via any of two or more switches 380.

In some embodiments, each heating bulb 320 is independently addressable via a corresponding local controller 375, such that the operation of each heating bulb 320 can be controlled without changing the operating status of any other heating bulb 320. In some embodiments, each heating bulb 320 is assigned to one or more groups of heating bulbs 320, and each group of heating bulbs 320 is independently addressable via one or more corresponding local controllers 375. In such embodiments, the operation of each heating bulb 320 within a defined group can be controlled without changing the operating status of any other heating bulb 320 that is not within the defined group. In some embodiments, the variation of the heat output of each heating bulb 320 may be adjusted during a drying/curing cycle based on one or more of the processes described in the co-pending, co-owned and related application titled "System and Method for Thermal-Visual Servoing," Ser. No. 17/845,668, referenced above.

In an example, each heating bulb 320 or group of heating bulbs 320 are associated with a discrete zone of the dryer 300. The control of each heating bulb 320, or group of heating bulbs 320, independently of other heating bulbs 320 of the dryer 300 facilitates the adjustment of heat distribution across the zones of the dryer 300.

In an example, a cluster of heating bulbs 320 at the center of the hood 302 are assigned to "Group A" and a cluster of heating bulbs 320 at an edge of the hood 302 are assigned to "Group B." The heating bulbs 320 of Group A can be controlled independently from the heating bulbs 320 of Group B. Additionally, the heating bulbs 320 of Group A can be controlled via a command addressed to the group, and the heating bulbs 320 of Group B do not respond to the command that is addressed to Group A. In such an example, the heating bulbs 320 of Groups A and B can be controlled to adjust the heating of the center of a garment relative to the heating of the edge of the garment. In some embodiments, one or more of Group A or Group B may be controlled by a corresponding local controller 375 according to one or more of the processes described in the co-pending, co-owned and related application titled "System and Method for Thermal-Visual Servoing," Ser. No. 17/845,668, referenced above.

Figure 4A:
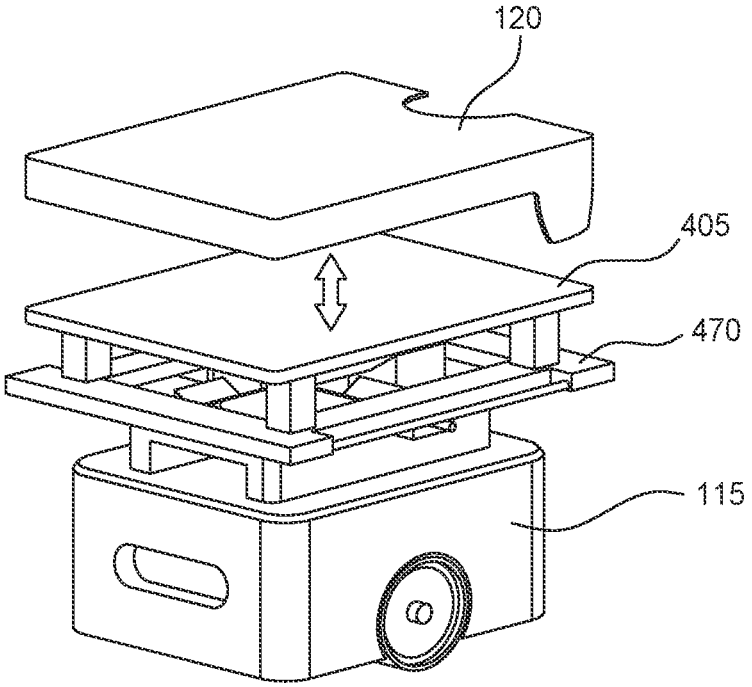
FIGS. 4A and 4B schematically illustrate an autonomous robot of the DTG printing environment of FIG. 1.
Figure 4B:
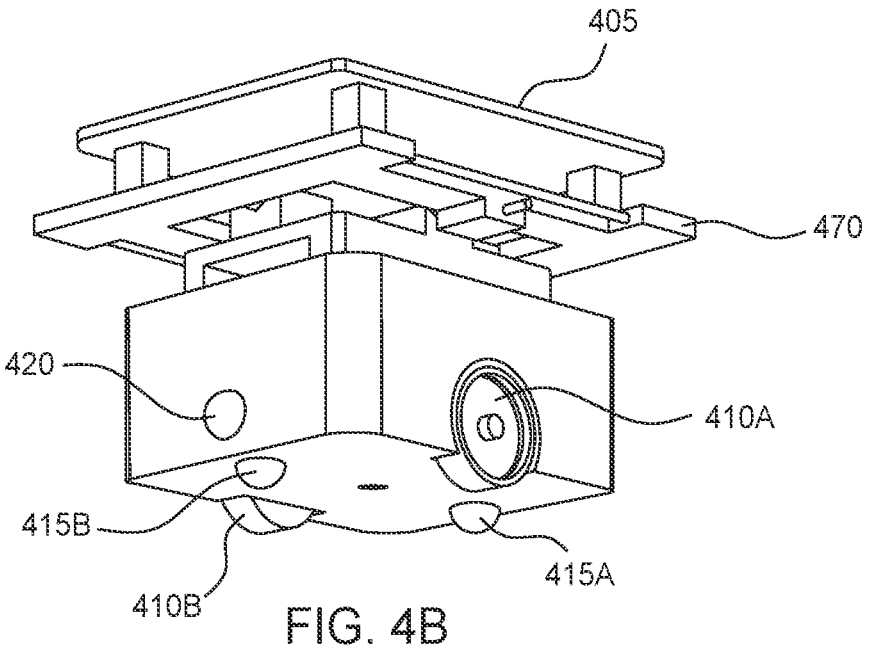

FIGS. 4A and 4B illustrate several views of the autonomous robot 115, according to embodiments. As shown in FIG. 4A, the carrier 470 is mounted on a top side of the robot 115. In one embodiment, the carrier 470 is detachable from the robot 115, and includes alignment features so that the carrier 470 is properly seated on the robot 115. Further, a platen 405 is disposed on a top side of the carrier 470. As used herein, the platen 405 is a flat platform on which the garment 120 is placed to provide support when performing digital printing or other operation on the garment 120. Referring to FIG. 1, the garment 120 is placed on the platen 405 at one of the garment retrieval stations 105.

In one embodiment, the garment is laid on top of the platen 405 or dressed thereon. Further, the platen 405 may have RFID and/or QR codes for identifying a type of platen, to perform an inventory check, to aid with computer vision, and/or for other purposes. For example, the RFID or QR codes can identify different sized platens 405 (such as small, medium, or large) that are configured to be used with different sized garments. In the case of garments dressed onto the platen 405, the platen 405 may be raised partially at an angle from the carrier 470 to allow the garment to be pulled over the platen 405. Air vent hoses or fingers, such as robotic fingers, may help open up the garment so it can slip onto the platen 405. The platen 405 can be adjustable for different sized garments 120. The platen 405 may have varying shape/contour to make dressing the garment 120 onto the platen 405 easier. Moreover, when the garment 120 is laid on the platen 405, a hooping frame and attachment assembly can keep the garment 120 taut, wrinkle free, and ready for printing.

FIG. 4B illustrates an underside of the robot 115. The robot 115 includes wheels 410 that are part of a drive system which can also include a motor and a power source (e.g., a battery) for navigating the robot 115 in an environment, such as on the floor (200, FIG. 2). While wheels 410 are shown, the robot 115 can be powered by other means such as a track. Further, the robot 115 includes casters 415, which may be unpowered wheels, that help to balance the robot 115. In some embodiments, the number of casters and their location may vary.

The robot 115 also includes a sensor 420, which can be a camera or a proximity sensor. For example, the sensor 420 may be a camera which is used to identify the grid and fiducials illustrated in FIG. 2. Additionally or alternatively, the sensor 420 can be used to detect neighboring robots and/or other objects to facilitate the prevention of collisions. The sensor 420 can be any environmental sensor that helps the robot 115 to move in the environment. For example, when using a different type of navigation system, the sensor 420 may be a magnetic or optical type sensor. While one sensor 420 is shown, the robot 115 may have multiple sensors of the same type or different types.

Figure 5A:
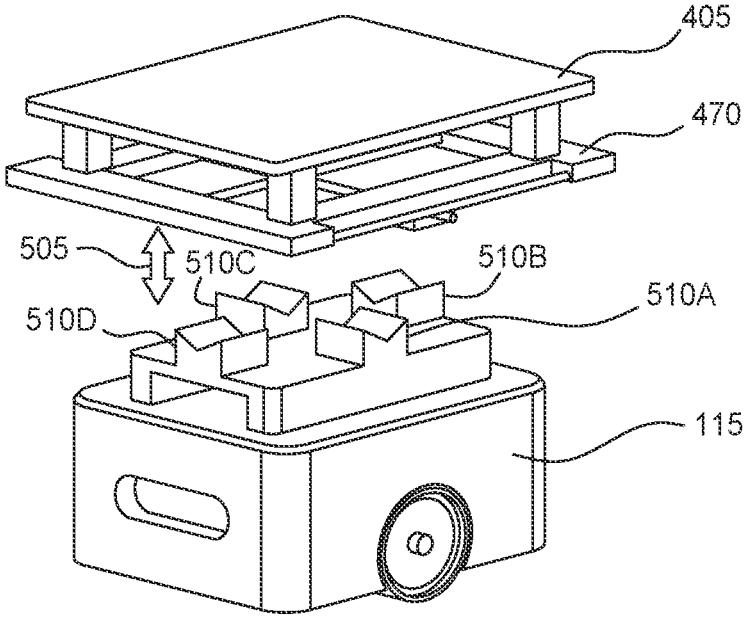
FIGS. 5A and 5B schematically illustrate a detachable carrier aligning to the autonomous robot of FIGS. 4A and 4B.
Figure 5B:
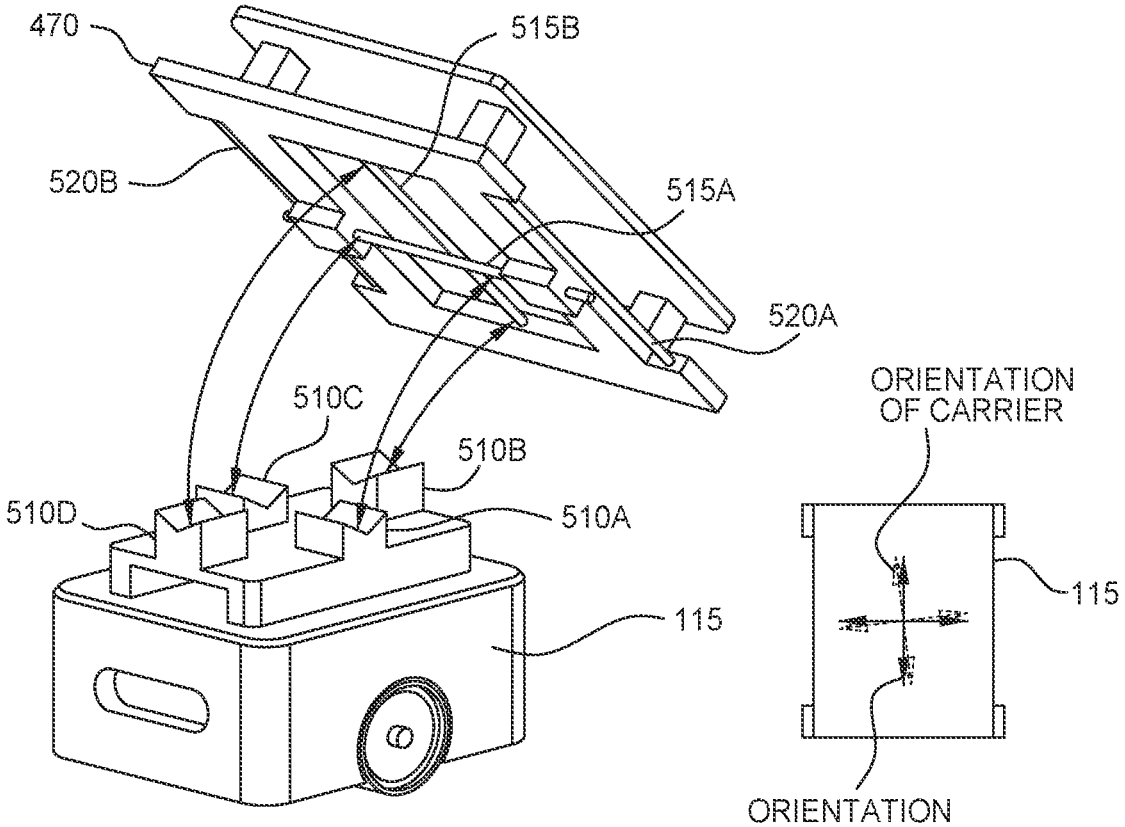

FIGS. 5A and 5B illustrate several views of a detachable carrier 470 aligning to an autonomous robot, according to embodiments. FIG. 5A illustrates a state where the carrier 470 is detached from the robot 115. The top side of the robot 115 includes four supporting features 510A-D which provide V-shaped guides for mating with corresponding supporting features in the carrier 470 (which are shown in FIG. 5B). The supporting features 510A-D are self-aligning so that when the carrier 470 is lowered onto the supporting features 510A-D, the carrier 470 adopts a desired orientation in the x-y plane (which is parallel to the ground). While the supporting features 510 are shown as V-shaped, they may also be U-shaped, or semi-circular shaped.

In some embodiments, the carrier 470 includes at least one expanding element to stretch the garment along a plane that is parallel to a ground surface. For example, one or more springs may be under the platen 405 to push out the platen in the X and Y directions to stretch and flatten the garment disposed on the platen 405. Doing so removes wrinkles in the garment that may have resulted from the garment retrieval process. Once in the stretched state, a hooping frame can be attached to the platen 405 to retain the garment in place. In some embodiments, the platen includes extension sections (may be in the middle) that are pulled into position using springs to accommodate for differing garment sizes. Rather than using springs, the expanding elements can be actuators that push out the platen to stretch and flatten the garments. Also, in one embodiment the platen 405 can be expanded by adding inserts to the platen 405 (like an insert for expanding a table) to accommodate different sized garments.

FIG. 5B illustrates the underside of the carrier 470, which includes supporting features 515A and 515B that mate with the supporting features 510A-D on the robot 115. The arrows in FIG. 5B illustrate that one side of the supporting feature 515A of the carrier 470 mates with the supporting feature 510A, and the other side of the supporting feature 515A mates with the supporting feature 510C. The arrows also illustrate that one side of the supporting feature 515B of the carrier 470 mates with the supporting feature 510B, and the other side of the supporting feature 515B mates with the supporting feature 510D.

When lowering the carrier 470 onto the robot 115, as shown by the arrow 505, an orientation of the carrier 470 may be different than an orientation of the robot 115. This difference in orientation is shown in FIG. 5B. However, so long as their orientations are generally the same, when the supporting features 515 on the carrier 470 contact the V-shaped portions of the supporting features 510, the sloped walls will adjust the orientation of the carrier 470 to substantially match the orientation of the robot 115. In this manner, mating the supporting features 510, 515 self-aligns the carrier 470.

FIGS. 5A and 5B also illustrate guides 520A, 520B along the sides of the carrier 470. The guides 520A, 520B can be used to raise the carrier 470 from the robot 115 and lower the carrier 470 onto the robot 115 as shown by arrow 505.

Figure 6A:
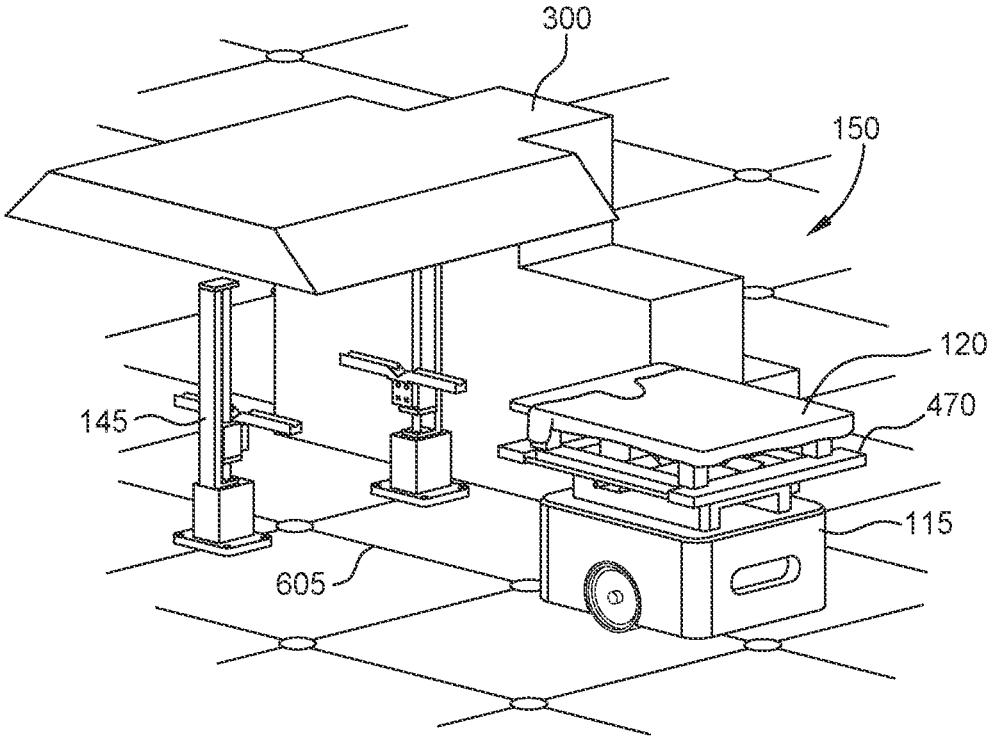
FIGS. 6A-6F schematically illustrate lifting a detachable carrier from an autonomous robot to perform a DTG processing stage.

FIGS. 6A-6F illustrate lifting a detachable carrier 470 from an autonomous robot 115 to perform a drying operation. FIG. 6A illustrates the robot 115 moving to a position underneath the hood 302 of a dryer 300. For example, the robot 115 can use a grid line 605 in order to navigate underneath the hood 302 so that the garment 120 and the heating bulbs of the dryer 300 are in a facing relationship.

Figure 6B:
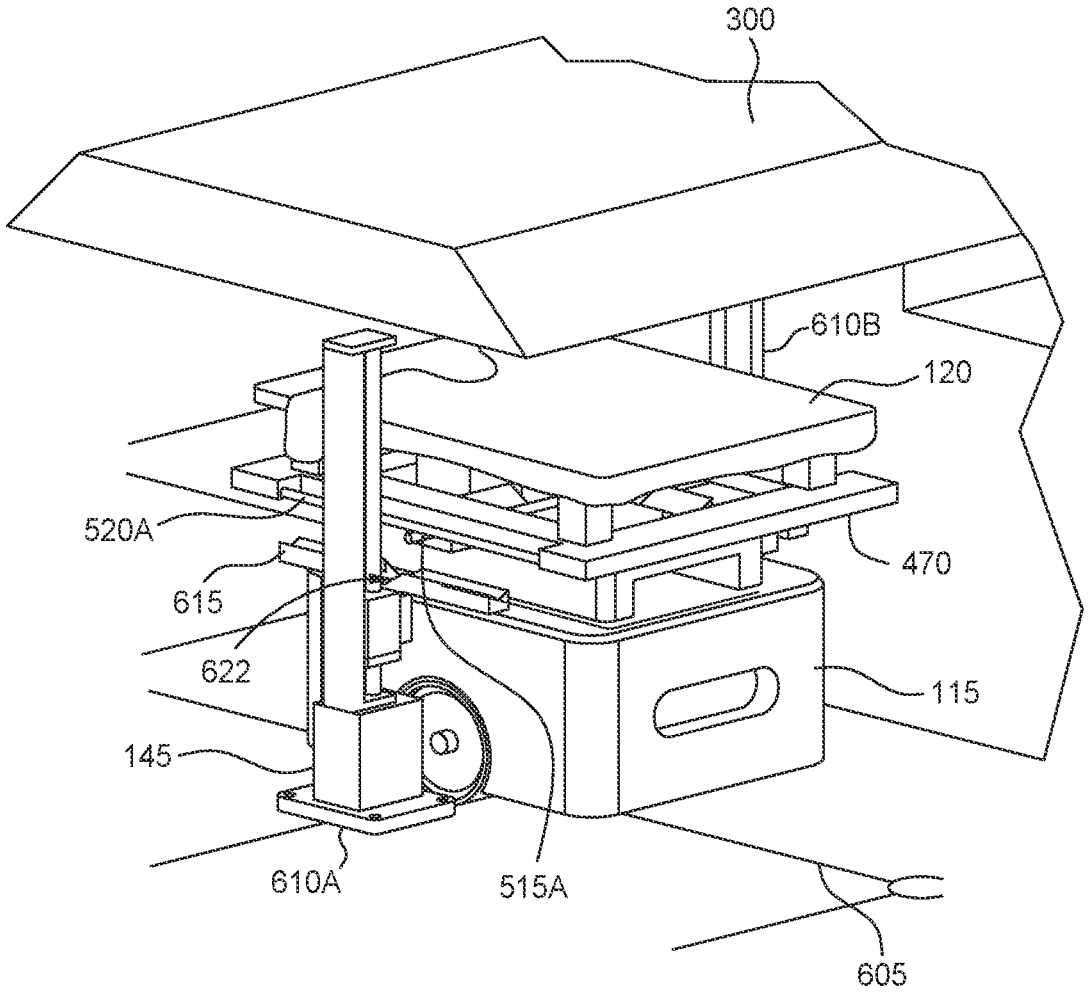

FIG. 6B illustrates when the robot 115 has moved into a desired position underneath the hood 302 of the dryer 300. In addition to moving the garment 120 to a position underneath the hood 302, the robot 115 also is disposed between two units of the lift 145. The lift 145 includes a first unit 610A disposed on one side of the robot 115 and a second unit 610B disposed on the opposite side of the robot 115. Each unit 610A, 610B includes an arm 615. When the robot 115 is disposed underneath the hood 302, each arm 615 is aligned with the corresponding guides 520A, 520B on the carrier 470. As discussed below, these arms 615 then mate with the guides 520A, 520B to lift the carrier 470 off the robot 115, and reduce the spatial distance between the garment on the carrier 470 and the hood 302 of the dryer 300.

In addition, the lift 145 includes alignment surfaces, such as V-blocks 622, disposed in the middle of the arms 615. The V-shape defined by the V-blocks 622 extend in a first direction while the V-shape in the arms 615 extends in a second, perpendicular direction. The V-block 622 on the arm 615 of the first unit 610A of the lift 145 is used to mate with the supporting feature 515A of the carrier 470, and the V-shape formed by the arm 615 mates with the guide 520A. Although hidden in the isometric view of FIG. 6B, a corresponding V-block 622 on the arm 615 of the second unit 610B of the lift 145 is used to mate with the other end of the supporting feature 515A of the carrier 470, and the V-shape formed by the arm 615 mates with the guide 520B.

In some embodiments, movement of the robot 115 provides a rough alignment between the garment 120 and the hood 302 of the dryer 300, and between the guides 520/supporting feature 515A and the arms 615N-block 622. The rough alignment is based on the ability of the robot 115 to follow the grid line 605 and stop at the desired location underneath the hood 302. However, the accuracy of the movement of the robot 115 may not be sufficient to ensure that the hood 302 and the garment are sufficiently aligned. In the operations that follow, the lift 145 can provide a more precise alignment between the garment and the hood 302, such as by manipulating the carrier 470. In some embodiments, the dryer 300 may not include a lift 145, and the carrier 470 may remain attached to the robot 115. In some embodiments, the dryer 300 may be operational without a lift 145, and the carrier 470 may detach from the robot 115 and be placed onto a stationary holder (not shown) that keeps the carrier 470 in place but at the same height as the robot 115. In such embodiments, the carrier 470 may not be raised by a lift 145 to a height closer to the dryer 300.

Figure 6C:
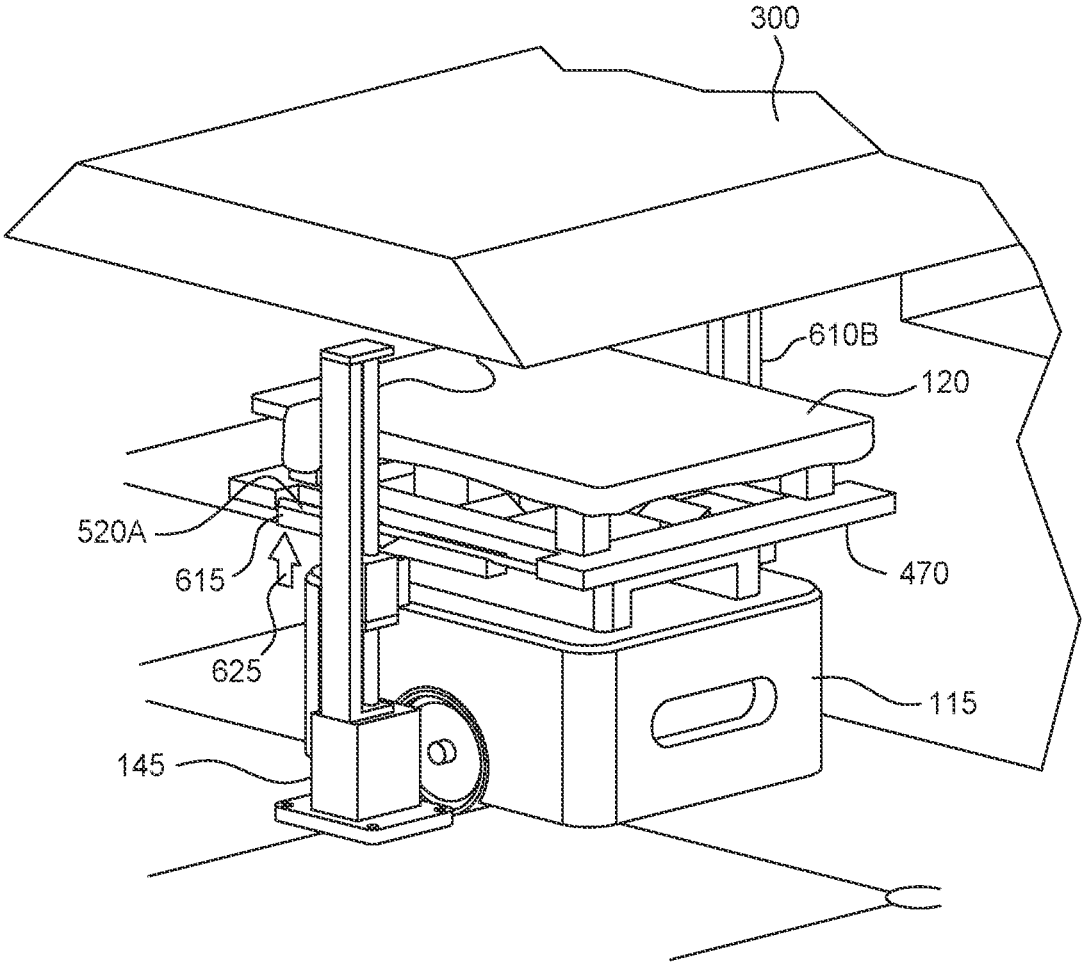

FIG. 6C illustrates operation of the lift 145. Operation of the lift 145 may be directed by a controller, such as primary controller 165, secondary controller 170, or dryer controller 370. Operation of the lift 145 commences by raising the arms 615 as shown by the arrow 625 until the V-block 622 mates with the supporting feature 515A and the arms 615 mate with the guides 520 on respective sides of the carrier 470. Using the lift 145 alleviates possible misalignment of the garment 120 with the hood 302. In an example, an uneven factory floor may cause the carrier 470 to be tilted with respect to the hood 302 while the carrier 470 is on the robot 115. The mating of the V-block 622 with the supporting feature 515A, and the arms 615 with the guides 520, promotes leveling of the carrier 470 when the lift 145 removes the carrier 470 from the robot 115, as described below.

Figure 6D:
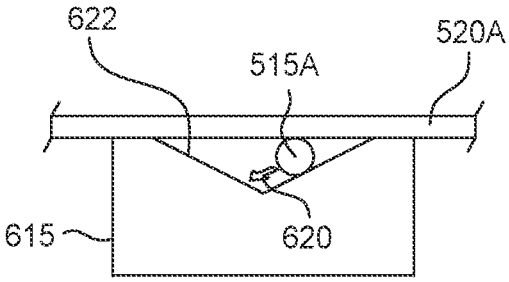
Figure 6E:
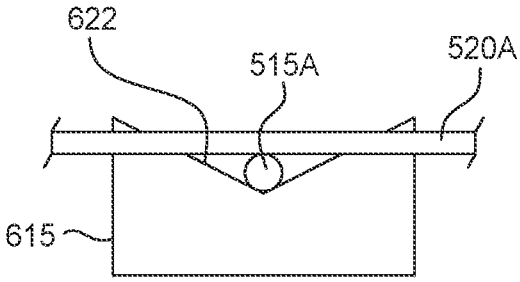

FIGS. 6D and 6E are side views of the V-block 622 and the arm 615. Specifically, FIG. 6D illustrates a point in time when the V-block 622 first contacts the supporting feature 515A. As shown, the supporting feature 515A (or more generally, the carrier 470) is misaligned with the V-block 622 since the supporting feature 515A is not seated in the middle of the V-block 622. As described above, such misalignment may be due to inaccuracies in the movement of the robot 115. However, as the lift 145 continues to raise the arm 615, it performs a self-aligning motion as shown by the arrow 620. The V-shape of the V-block 622 urges the supporting feature 515A to move towards the middle of the V, thereby aligning the carrier 470 with the lift 145. In this manner, as the lift 145 raises the carrier 470 off the robot 115, the weight of the carrier 470 enables the supporting feature 515A and the V-blocks 622 to self-align. The result is illustrated in FIG. 6E where the supporting feature 515A is seated in the middle of the V-shape of the V-block 622. In another embodiment, the V-block 622 may be U-shaped or have a different self-aligning shape.

A similar self-aligning or self-centering process can occur in the V-shape formed in the arm 615 that is perpendicular to the V-shape in the V-block 622. In such a case, the guide 520A may contact a sidewall of the V formed by the arm 615, which urges the guide 520A into the middle of the V-shape, thereby aligning or centering the carrier 470 with the lift 145. In one embodiment, the V-block 622 and the arm 615 are designed so that the supporting feature 515A contacts the V-block 622 before the guide 520A contacts the arm 615. In this manner, the V-blocks 622 align the carrier 470 in a first direction (e.g., the X-direction) while the arms 615 align the carrier 470 in a second, perpendicular direction (e.g., the Y-direction). The lift 145 and all corresponding structures can be calibrated to a reference plane. For example, the reference plane may be parallel to the ground plane of the floor 200. Additionally, or alternatively, the reference plane may be the same as, or parallel to, a reference plane of the hood 302, such as a plane described by the lower end 335 of the shroud 330. Such calibration of the lift 145 alleviates tilting of the carrier 470 as the carrier 470 is being moved towards the hood 302.

The alignment between the arms 615 of the lift 145 and the hood 302 of the dryer 300 can be precisely controlled during installation at the work site. Such alignment may be checked and adjusted during periodic maintenance. Thus, aligning the carrier 470 with the arms 615 inherently aligns the carrier 470 with the hood 302. Accordingly, if the carrier 470 has an orientation that is slightly off, or is not precisely level, when disposed on the robot 115, raising the carrier 470 using the lift 145 can correct the orientation of the carrier 470 and level it relative to the reference plane. Further, although not shown, the lift 145 can include sensors (e.g., position and/or distance sensors) to determine the position, orientation, and alignment of the garment 120 with respect to the hood 302. The sensors can be mechanical, optical, and magnetic sensors. The sensors can provide feedback to the controller of the lift 145, and the controller can adjust the lift 145 accordingly. Moreover, data from the sensors could be used to adjust the movement system of the robot 115 (e.g., to detect when one wheel turns faster than the other) or when there is damage to the robot 115.

Figure 6F:
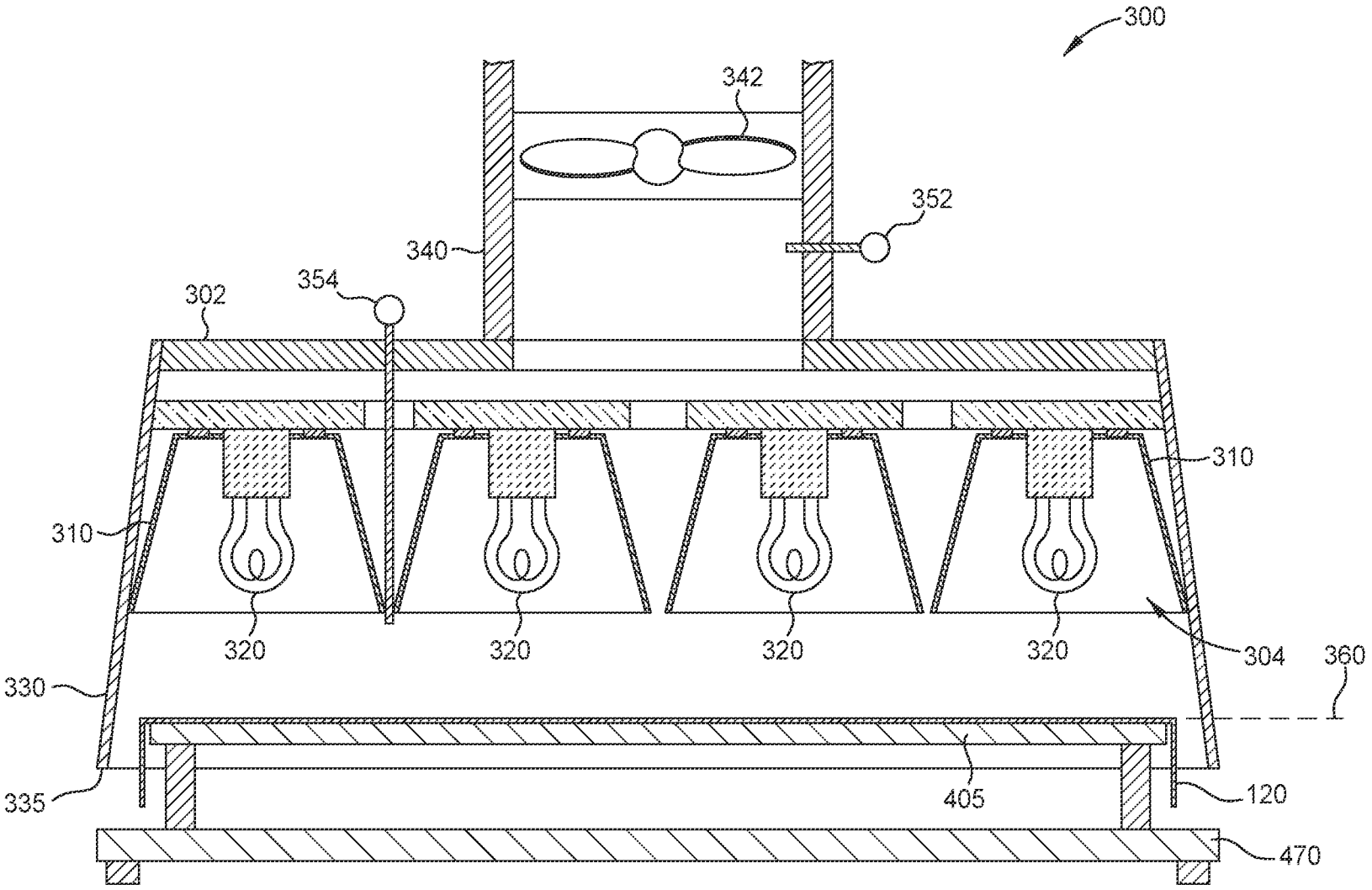

FIG. 6F is a schematic cross-sectional view through the hood 302, and illustrates the situation when the arms 615 of the lift 145 have raised the carrier 470 such that the garment 120 is positioned with respect to the hood 302 for drying. In some embodiments, the garment 120 is positioned at the nominal elevation 360 of a garment to be dried, between the reflectors 310 and the lower end 335 of the shroud 330. In some embodiments, the nominal elevation 360 of a garment to be dried may be defined specifically for the particular garment 120 to be dried, and may be different for a different garment to be dried. The drying operation is described below with respect to FIGS. 7 and 8A-8G.

Once the garment 120 has been dried, the lift 145 lowers the carrier 470 back onto the robot 115. As discussed in FIGS. 5A and 5B, the supporting features 510A-D on the robot 115 and the supporting features 520A-B on the carrier 470 can be used to realign the carrier 470 with the robot 115. For example, if the orientation of the carrier 470 was changed by the lift 145, the orientation of the carrier 470 can be re-centered with the orientation of the robot 115 by the supporting features 510A-D when the carrier 470 is lowered onto the robot 115. The robot 115 is then free to transport the carrier 470 and the garment 120 to the next station in the digital printing process.

In one embodiment, because of the time required to dry the garment 120, the primary controller 165 or secondary controller 170 may instruct the robot 115 to move to a battery charging point or to a different station to retrieve a different garment and move that garment to another station. The robot 115 that retrieves the garment 120 once drying is complete might not be the same robot 115 that brought the garment to the dryer 300. Whenever the carrier 470 is removed from the robot 115, the robot 115 may be used to perform another operation, such as retrieving and moving a different garment, rather than sitting idle. Such operational flexibility enables the DTG printing system 100 to realize the same throughput as, but using fewer robots 115 than, a system that requires the robots 115 to drop off and retrieve the same garment 120 at each station.

As described above, the embodiments herein are not limited to using a detachable carrier 470 in order to move the garment into a position for drying. Any actuator can be used that reduces the spatial distance between the garment 120 being carried by the robot 115 and the hood 302 of the dryer 300. For example, the robot 115 may drive on top of a lift which lifts the entire robot 115 and the carrier 470. The lift may tilt and rotate in order to level the garment 120 and ensure the garment 120 has the correct orientation with the hood 302 of the dryer 300. In another example, a lift may be integrated into the robot 115 for raising, lowering, and aligning the carrier 470 with the hood 302 of the dryer 300. Such a system may incorporate level gauges and actuators to correct for unevenness of the floor. In yet another example, the hood 302 of the dryer 300 may be lowered in order to decrease the vertical distance between the hood 302 and the garment 120 on the robot 115 (while the robot 115 remains stationary). The dryer 300 may incorporate level gauges and actuators in order to level and orient the hood 302 in order to match the plane and orientation of the garment 120. For example, such leveling and orientation may correct for an uneven floor or improve upon a rough alignment provided by the robot 115. In another embodiment, the dryer 300 may include a first actuator for moving the hood 302 and a second actuator for moving the carrier 470 in order to align the garment 120 with the hood 302.

Figure 7:
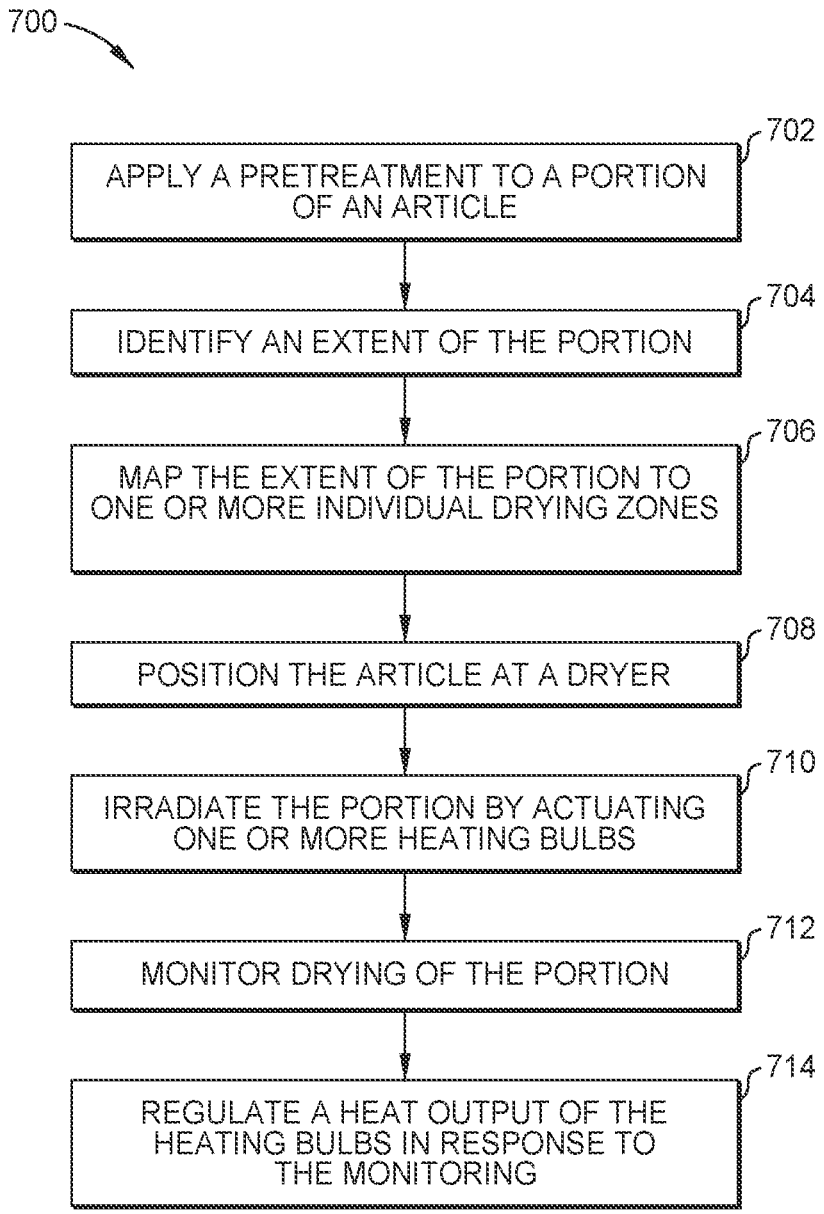
FIG. 7 is a flow chart for performing a drying or curing operation.

FIG. 7 is a flow chart of a method 700 for drying an article and/or curing ink applied to an article, such as a garment 120 or other item described above. Examples of selected operations of the method 700 are illustrated in FIGS. 8A-8E. At operation 702, a pretreatment solution is applied to at least a portion of the article. In an example, the pretreatment is performed at a pretreatment station (125, FIG. 1). At operation 704, an extent of the pretreated portion is identified. In some embodiments, identifying the extent of the pretreated portion includes scanning the article with a moisture sensor, such as an optical moisture sensor or an IR moisture sensor. In some embodiments, identifying the extent of the pretreated portion includes scanning the article with a heat sensor, such as a temperature sensor, such as an IR sensor. In some embodiments, identifying the extent of the pretreated portion includes recording a location of an applicator relative to the article while the applicator applies the pretreatment solution to the article.

Figure 8C:
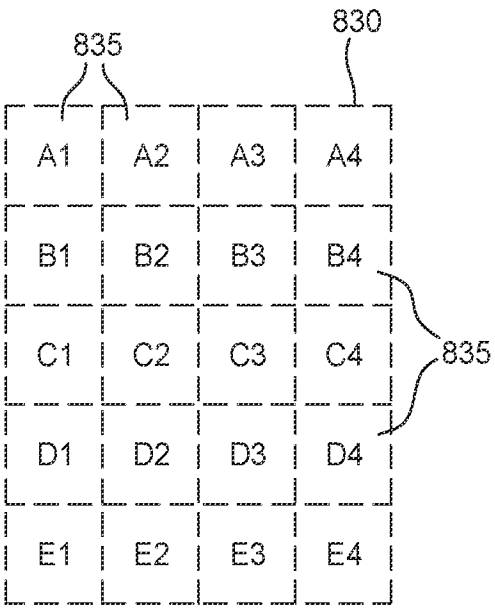
FIGS. 8A-8G schematically illustrate some of the operations described in the flow chart of FIG. 7.
Figure 8B:
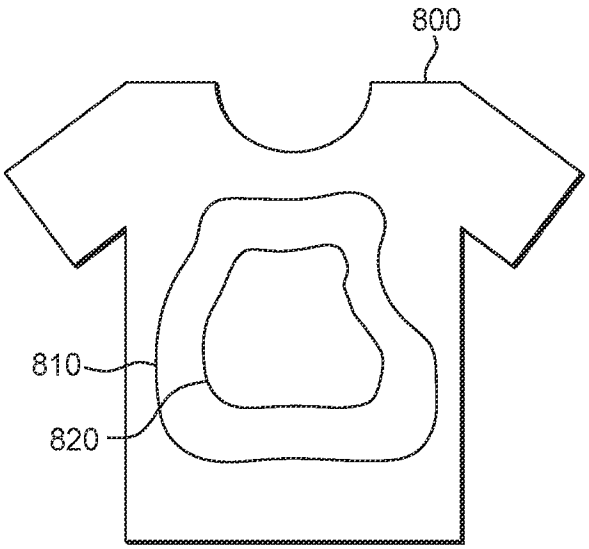
Figure 8A:
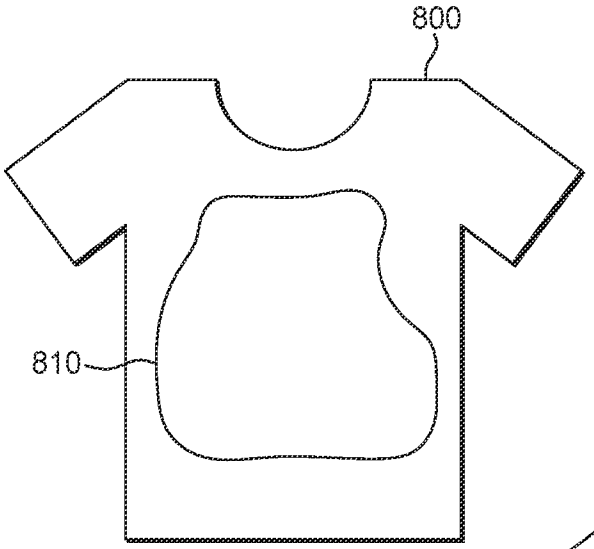

FIG. 8A schematically shows an article 800 including a pretreated portion 810. In some embodiments, as illustrated in FIG. 8B, the article 800 may include a printed portion 820 in which a design is printed on the pretreated portion 810, such as by a wet-on-wet printing process. The extent of the printed portion 820 is within the extent of the pretreated portion 810. The method 700 may include an operation of identifying the extent of the printed portion 820. In some embodiments, identifying the extent of the printed portion 820 includes scanning the article 800 with a moisture sensor, such as an optical moisture sensor or an IR moisture sensor. In some embodiments, identifying the extent of the printed portion 820 includes scanning the article 800 with a heat sensor, such as a temperature sensor, such as an IR sensor. In some embodiments, identifying the extent of the printed portion 820 includes scanning the article 800 with a Hall Effect sensor that detects the presence of magnetic materials in the ink of the printed design. In some embodiments, identifying the extent of the printed portion 820 includes recording a location of a printhead relative to the article 800 while the printhead applies the design to the article 800.

In some embodiments, the identifying of the extent of the pretreated portion 810 and/or the identifying of the extent of the printed portion 820 is facilitated by the dryer controller 370 receiving input data, such as from a menu. For example, the input data may include any one or more of: the type of the article 800 (such as a T-shirt, pillowcase, or other article type discussed above), the size of the article 800, the type of printing process (such as wet-on-wet, wet-on-dry, screen printing, and so forth), or the catalogue number of the design that is printed (for example, catalogue number 47 is a cartoon character and catalogue number 95 is a slogan). In some embodiments, at least some of the input data may be entered by a human. In some embodiments, at least some of the input data may be entered by scanning a code, such as a QR code, associated with the article 800.

Returning to FIG. 7, at operation 706, the extent of the pretreated portion 810 is mapped to one or more individual drying zones of a dryer 300. A drying zone is a region of a dryer 300 that can be irradiated by one or more heating bulbs 320. One or more heating bulbs 320 are assigned to each drying zone. In some embodiments, a heating bulb 320 may be assigned to a single drying zone. In some embodiments, a heating bulb 320 may be assigned to a single drying zone even though the heating bulb 320 (with the corresponding reflector 310) is configured to irradiate more than one drying zone. In some embodiments, a heating bulb 320 may be assigned to more than one drying zone.

Figure 8D:
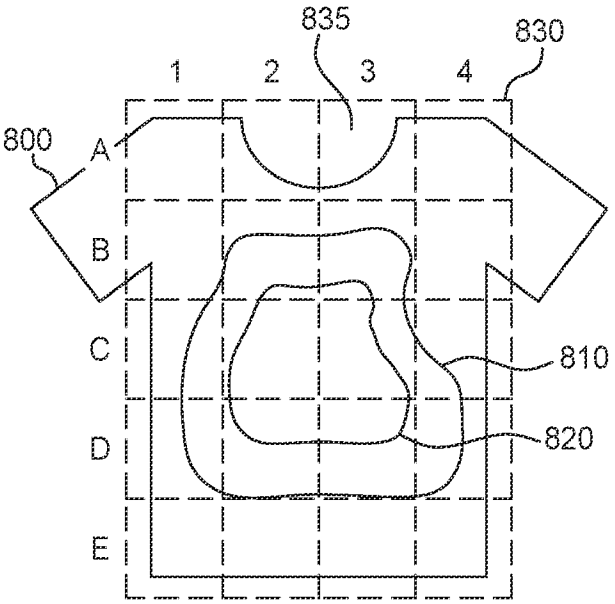
Figure 8E:
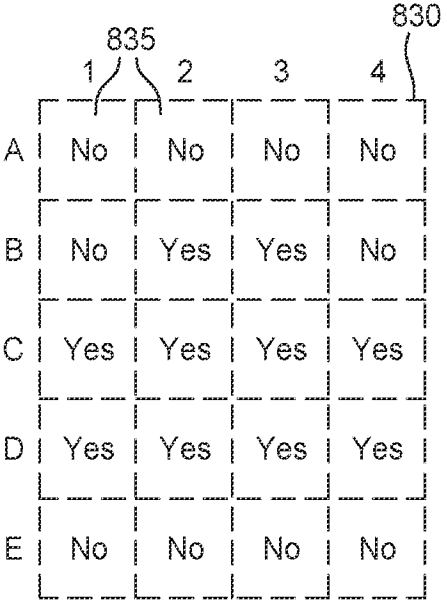

FIGS. 8C-8E illustrate an example mapping. FIG. 8C schematically shows a grid 830 including cells 835, and each cell 835 is labeled with a unique identifier. Each cell 835 corresponds to an individual drying zone or a group of individual drying zones. FIG. 8D schematically shows the grid 830 superimposed upon the article 800. FIG. 8E reports whether or not a relevant part of the pretreated portion 810 appears in each cell 835 when the grid 830 is superimposed on the article 800 in FIG. 8D. In the illustrated example, only a small part of cell B1 overlaps the pretreated portion 810, and cell B1 is considered not to correspond to a part of the pretreated portion 810. However, in some embodiments, the situation illustrated for cell B1 may result in cell B1 being considered to correspond to a part of the pretreated portion 810.

The mapping outcome, illustrated in FIG. 8E, results in each drying zone being identified either as an active drying zone or a passive drying zone. An active drying zone is a drying zone for which the one or more heating bulbs 320 assigned thereto are to be actuated to irradiate the article 800. A passive drying zone is a drying zone for which the one or more heating bulbs 320 assigned thereto are not to be actuated to irradiate the article 800. In the illustrated example, cells B2, B3, C1-C4, and D1-D4 correspond to active drying zones, and cells A1-A4, B1, B4, and E1-E4 correspond to passive drying zones. In another example, the pretreated portion 810 can occupy an area such that the extent of the pretreated portion 810 overlaps with every cell 835, and every drying zone is designated as an active drying zone.

In embodiments in which the article includes a pretreated portion 810 and a printed portion 820, as illustrated in FIGS. 8B and 8D, the method 700 may include an operation of mapping the extent of the printed portion 820 to individual drying zones of the plurality of drying zones. The mapping of the extent of the printed portion 820 to individual drying zones may be conducted in the manner described above. In some embodiments, the mapping of the extent of the printed portion 820 to individual drying zones may be conducted at least partially simultaneously with the mapping of the extent of the pretreated portion 810 to individual drying zones. An outcome of the mapping of the extents of the pretreated portion 810 and the printed portion 820 is the identification of two subsets of active drying zones. A first subset of the set of active drying zones corresponds to a region of the article 800 between the extent of the pretreated portion 810 and the extent of the printed portion 820. A second subset of the set of active drying zones corresponds to the extent of the printed portion 820.

Returning to FIG. 7, at operation 708, the article is positioned at a dryer 300, such as described above with respect to FIGS. 6A-6F. In some embodiments, operation 706 is performed before operation 708. In some embodiments, operation 706 is performed after operation 708. In some embodiments, operation 706 is performed at least partially simultaneously with operation 708. In some embodiments, operation 704 is performed before operation 708. In some embodiments, operation 704 is performed after operation 708. In some embodiments, operation 704 is performed at least partially simultaneously with operation 708.

In some embodiments, the article is positioned at a dryer 300, and sensors, such as sensors 354, of the dryer 300 are used in identifying an extent of the pretreated portion 810 and/or the printed portion 820 of the article 800, such as by measuring moisture contents of different parts of the article 800. In some embodiments, the dryer controller 370 uses data from the sensors, such as sensors 354, of the dryer 300 to map the extent of the pretreated portion 810 and/or the printed portion 820 of the article 800 to one or more individual drying zones of the dryer 300.

At operation 710, the pretreated portion 810 of the article is irradiated by actuating one or more heating bulbs 320 of the dryer 300. The actuated heating bulbs 320 are those heating bulbs 320 assigned to one or more active drying zones. Heating bulbs 320 assigned only to one or more passive drying zones are maintained unactuated. Heating bulbs 320 assigned to one or more active drying zones and to one or more passive drying zones may be actuated, may be maintained unactuated, or may be repeatedly switched between actuated and unactuated states. In some embodiments, the variation of the heat output of a heating bulb 320 may be adjusted during a drying/curing cycle based on one or more of the processes described in the co-pending, co-owned and related application titled "System and Method for Thermal-Visual Servoing," Ser. No. 17/845,668, referenced above.

Figure 8F:
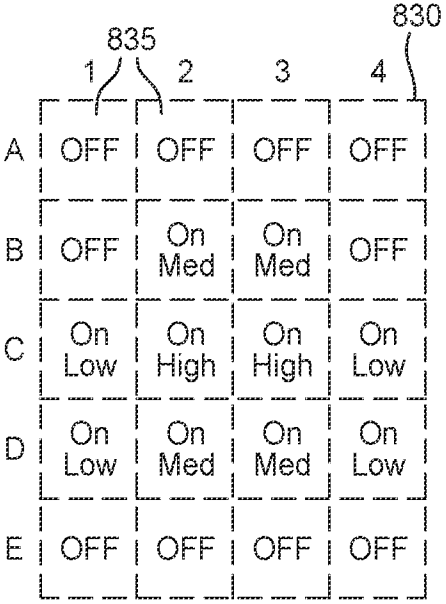

FIG. 8F illustrates the actuation of heating bulbs 320 of the active drying zones and the non-actuation of heating bulbs 320 of the passive drying zones resulting from the mapping shown in FIG. 8E. Cells 835 in the grid 830 corresponding to the passive drying zones are labeled as being "Off." Heating bulbs 320 assigned only to one or more passive drying zones are maintained unactuated. Cells 835 in the grid 830 corresponding to the active drying zones are labeled as being "On." Heating bulbs 320 assigned to one or more active drying zones are actuated.

In some embodiments, each actuated heating bulb 320 is switched on at the same preset level of heat output (such as 25% power, 50% power, 75% power, or 100% power). In some embodiments, as shown in FIG. 8F, each actuated heating bulb 320 is switched on at a preset level of heat output that may be different from the level of heat output at which one or more other heating bulbs 320 are actuated. In the illustrated example, heating bulbs 320 assigned to active drying zones corresponding to cells C2 and C3 are actuated to emit heat at a relatively high output level. In the illustrated example, heating bulbs 320 assigned to active drying zones corresponding to cells B2, B3, D2, and D3 are actuated to emit heat at a relatively medium output level. In the illustrated example, heating bulbs 320 assigned to active drying zones corresponding to cells C1, C4, D1, and D4 are actuated to emit heat at a relatively low output level.

In embodiments in which the designated active drying zones have been delineated into the first and second subsets (as described above), one or more heating bulbs 320 of the first subset of active drying zones may be regulated to emit heat up to a first limit, and one or more heating bulbs 320 of the second subset of active drying zones may be regulated to emit heat up to a second limit. Each limit corresponds to a maximum level of heat output specified for the article 800 being dried. In some embodiments, the first limit is the same as the second limit. In some embodiments, the first limit is greater than the second limit. In some embodiments, the first limit is less than the second limit.

In some embodiments, the dryer controller 370 determines a heat output level for each heating bulb 320 of an active drying zone, and regulates the heat output of each heating bulb 320 accordingly. The determining of the heat output level for each heating bulb 320 of an active drying zone is achieved by analyzing one or more input parameters. Examples of input parameters include any one or more of: the type of material of the article 800, the thickness of the material of the article 800, the moisture content of parts of the pretreated portion 810 of the article 800, the type and/or chemical composition of the pretreatment solution applied to the article 800, the quantity of pretreatment solution applied to the article 800, the moisture content of parts of the printed portion 820 of the article 800, the type and/or chemical composition of the ink applied to the printed portion 820 of the article 800, or the quantity of ink applied to the article 800.

Returning to FIG. 7, at operation 712, the drying of the pretreated portion 810 of the article 800 is monitored. In embodiments in which the article 800 includes a pretreated portion 810 and a printed portion 820, the operation 712 may include monitoring the drying of the printed portion 820. Additionally, in embodiments in which the article 800 includes a pretreated portion 810 and a printed portion 820, the operation 712 may include monitoring the curing of the ink at the printed portion 820. The monitoring of the drying of the pretreated portion 810 and/or the printed portion 820 of the article 800 is conducted while irradiating the article 800. In some embodiments, the monitoring includes acquiring data from the one or more sensors 352. In some embodiments, the monitoring includes acquiring data from the one or more sensors 354. In some embodiments, the monitoring includes acquiring data from the one or more sensors 352 and from the one or more sensors 354.

Figure 8G:
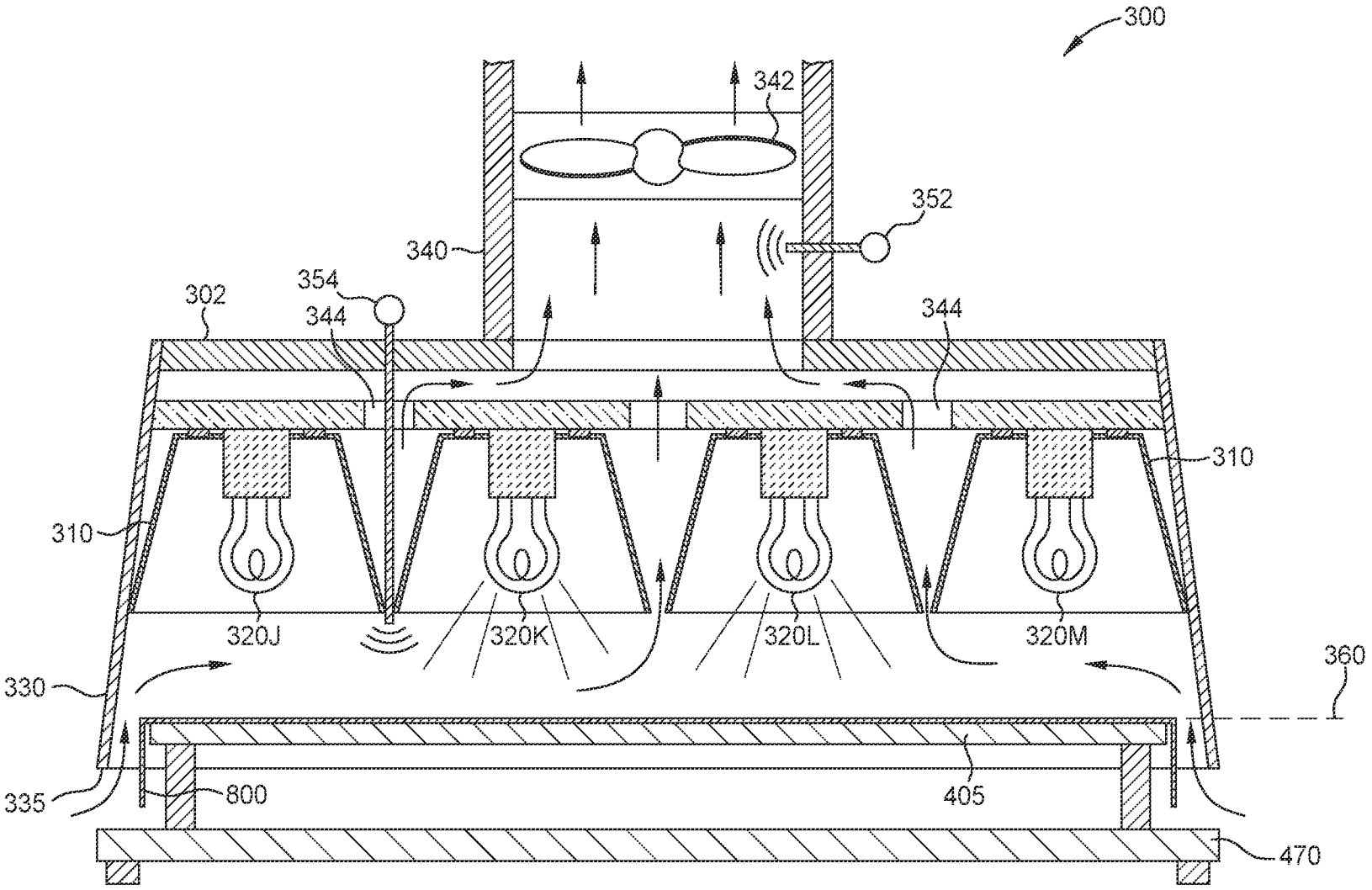

FIG. 8G is a schematic cross-sectional view of the dryer 300 during the drying operation. The article 800 is on a platen 405, and is positioned between the reflectors 310 and the lower end 335 of the shroud 330. In the illustrated example, heating bulbs 320K and 320L are actuated, whereas heating bulbs 320J and 320M are maintained unactuated. The fan 342 is actuated, and draws air from around the article 800 through the hood 302 and into the exhaust vent 340. The passage of the air is depicted by arrows in the Figure. The sensor(s) 352 disposed in the exhaust vent 340 measures one or more parameters of the air in the exhaust vent 340 related to the drying of the article 800, as described above. In embodiments in which the article 800 includes a pretreated portion 810 and a printed portion 820, the sensor (s) 352 disposed in the exhaust vent 340 may monitor for chemical compounds and/or particulates in the air that are generated by the drying and/or curing of the ink of the printed portion 820 of the article 800. In an example, as the ink dries/cures, volatile organic compounds (VOCs) are released. Over time, a concentration of VOCs that decreases from a maximum level may indicate that drying/curing of the ink is nearing completion. The sensor(s) 354 disposed in the hood 302 measure one or more parameters related to the drying of the article 800, as described above.

Returning to FIG. 7, at operation 714, the heat output of one or more of the heating bulbs 320 is regulated in response to the data acquired by monitoring the drying of the article 800. In some embodiments, one or more aspects of operation 714 are conducted simultaneously with one or more aspects of operation 710. In some embodiments, one or more aspects of operation 714 are conducted simultaneously with one or more aspects of operation 712. In some embodiments, one or more aspects of operation 714 are conducted simultaneously with one or more aspects of operation 710 and simultaneously with one or more aspects of operation 712.

In an example operation, parts of the article 800 in some drying zones may dry faster than other parts of the article 800 that are in other drying zones. The dryer controller 370 may adjust the heat output of selected heating bulbs 320. The dryer controller 370 may reduce the heat output of heating bulbs 320 associated with drying zones in which the article 800 is drying faster, such as to save energy or to avoid burning the article. The dryer controller 370 may increase the heat output of heating bulbs 320 associated with drying zones in which the article 800 is drying more slowly, such as to save time.

At the end of the drying operation, all heating bulbs 320 that are still switched on are deactuated. The article 800 is removed from the dryer 300, such as described above with respect to the operation of the lift 145.

In some embodiments, the dryer 300 is used to dry/cure a design printed onto an article 800 in a wet-on-dry printing process. In such embodiments, the pretreated portion 810 (if any) is dry before the design is printed onto the article 800. The method 700 is modified such that operation 702 involves printing the design onto a portion 820 the article 800 (instead of applying the pretreatment), operation 704 involves identifying an extent of the printed portion 820 (instead of identifying an extent of the pretreated portion 810), and operation 712 involves monitoring the drying and/or curing of the ink, as described above.

Figure 9:
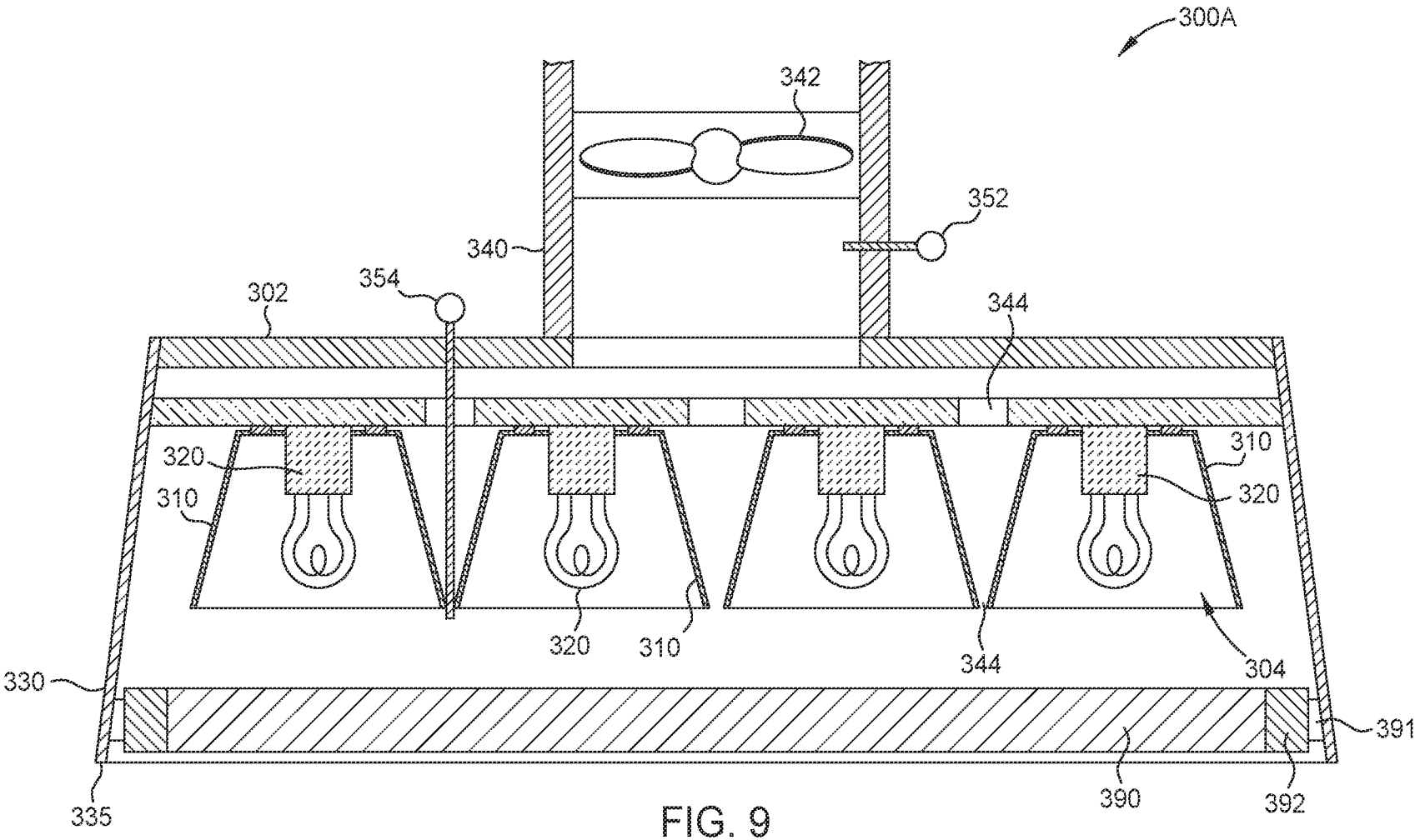
FIG. 9 schematically illustrates a dryer that may be used in place of the dryer illustrated in FIGS. 3A-3H.

FIG. 9 schematically illustrates in cross-section a dryer 300A that may be used in place of dryer 300 when performing one or more methods of the present disclosure. Dryer 300A includes features of dryer 300; components common to dryer 300 and dryer 300A retain similar reference numerals. In some embodiments, operation of the dryer 300A is controlled by a controller, such as the primary controller 165, the secondary controller 170, the dryer controller 370, and/or one or more local controllers 375, described above.

The dryer 300A includes a hood 302 with a plurality of compartments 304. Each compartment 304 includes a reflector 310 that is configured to direct incident radiation, such as optical light, UV light, and/or IR light, towards a corresponding region, such as below the reflector 310. A heating bulb 320 is disposed in each compartment 304. In some embodiments, the heating bulb 320 is configured to emit IR radiation, such as long wave, medium wave, and/or short wave IR radiation. In some embodiments, the heating bulb 320 is configured to emit near IR radiation. A shroud 330 circumscribes the reflectors 310, and extends below the reflectors 310.

In some embodiments, the dryer 300A includes one or more configurations of reflectors 310 and heating bulbs 320 as described above with respect to any of FIGS. 3B-3D. In some embodiments, the dryer 300A is configured to provide one or more lighting configurations of reflectors 310 and heating bulbs 320 as described above with respect to FIGS. 3E and 3F. In some embodiments, the heating bulbs 320 of the dryer 300A may be controlled via one or more of the arrangements described above with respect to FIGS. 3G and 3H.

As with dryer 300, it should be noted that the numbers and arrangements of compartments 304 and heating bulbs 320 of dryer 300A depicted in the Figures are purely for illustrative purposes. For example, in some embodiments, the compartments 304 and heating bulbs 320 may be arranged such that each successive row of compartments 304 and heating bulbs 320 is offset from the previous row. Additionally, or alternatively, the compartments 304 and heating bulbs 320 may be arranged such that the heating bulbs 320 are more closely spaced in some areas of the hood 302 than in other areas of the hood 302.

An exhaust vent 340 is coupled to the hood 302. A fan 342 disposed in the exhaust vent 340 is configured to draw air through the hood 302, such as via apertures 344, and expel the air through the exhaust vent 340. One or more sensors 352 disposed in the exhaust vent 340 are configured to measure one or more parameters related to the garment being dried by the dryer 300A, such as one or more parameters of the air in the exhaust vent 340. In an example, the one or more sensors 352 are configured to measure any one or more of temperature, pressure, flow rate, or humidity. In another example, the one or more sensors 352 include an optical or IR sensor configured to measure a quantity of one or more chemicals present in the air, such as carbon dioxide, carbon monoxide, nitrogen oxides, and/or volatile organic compounds. In another example, the one or more sensors 352 include a particle sensor, such as an optical or IR sensor, configured to measure a quantity of particulate material present in the air. In some embodiments, the one or more sensors 352 are configured to measure a combination of any two or more of the above parameters.

One or more sensors 354 are disposed in the hood 302, and are configured to measure a parameter related to the garment being dried by the dryer 300A. In an example, the one or more sensors 354 include a thermal imaging camera configured to measure a temperature of a portion of the garment being dried. In another example, the one or more sensors 354 include a moisture sensor, such as an optical sensor, configured to measure a moisture content of air above a corresponding portion of the garment being dried. In another example, the one or more sensors 354 include a moisture sensor, such as an optical sensor or an IR moisture sensor, configured to measure a moisture content of a portion of the garment being dried. In some embodiments, a plurality of sensors 354 is disposed in the hood 302, the plurality of sensors 354 including one or more sensors 354 configured to measure one of the above parameters, and including one or more sensors 354 configured to measure a different one of the above parameters.

In some embodiments, data from the one or more sensors 352 and/or data from the one or more sensors 354 is used in controlling the operation of the dryer 300 by performing one or more of the methods described in the present disclosure. In some embodiments, data from the one or more sensors 352 and/or data from the one or more sensors 354 is used in controlling the operation of the dryer 300 by performing one or more of the methods described in the co-pending and co-owned application titled "System and Method for Thermal-Visual Servoing," Ser. No. 17/845,668, referenced above.

The dryer 300A includes a pressure plate 390 coupled to the hood 302. As illustrated, in some embodiments the pressure plate 390 is coupled to a shroud 330 of the hood 302 via one or more brackets 391. The coupling with the brackets 391 enables air to flow into the hood 302 from below the pressure plate 390, such as in between adjacent brackets 291. The pressure plate 390 is mounted below the heating bulbs 320. As illustrated, in some embodiments, the pressure plate 390 is mounted within the shroud 330. Alternatively, the pressure plate 390 may be mounted below the lower end 335 of the shroud 330. Alternatively, the pressure plate 390 may be mounted partially within the shroud 330 and protruding below the lower end 335 of the shroud 330.

The pressure plate 390 includes a material that is substantially transparent to infrared radiation. In an example, at least 75% of incident infrared radiation may be transmitted through the material. In other examples, at least 80%, at least 85%, at least 90%, or at least 95% of incident infrared radiation may be transmitted through the material. Exemplary materials include quartz, zinc selenide, zinc sulfide, acrylic glass, plexiglass, and the like.

In some embodiments, a surface of the pressure plate 390 that faces a garment being dried and/or pressed is configured to resist the transfer of ink and/or dye from the garment to the pressure plate 390. In an example, the surface may include a coating of a non-stick material, such as PTFE. In some embodiments, a barrier sheet may be interposed between the pressure plate 390 and the garment being dried and/or pressed in order to hinder the transfer of ink and/or dye from the garment to the pressure plate 390. In some of such embodiments, the barrier is present when pressure is applied to the garment via the pressure plate 390, and is absent when pressure is not applied to the garment via the pressure plate 390. In some embodiments, the barrier is present when pressure is applied to the garment via the pressure plate 390, and when pressure is not applied to the garment via the pressure plate 390. In some embodiments, the barrier includes a material that is substantially transparent to infrared radiation, as described above. In some embodiments, the barrier includes a paper-based material.

In some embodiments, the pressure plate 390 may be heated. As illustrated, in some embodiments, the pressure plate 390 is heated by a heating jacket 392 positioned around an outer edge of the pressure plate 390. In some embodiments, the heating jacket 392 includes one or more electrical heating elements. In some embodiments, the heating provided by the heating jacket 392 is controlled by a controller, such as the primary controller 165, the secondary controller 170, the dryer controller 370, and/or a local controller 375, described above. In some embodiments, the heating provided by the heating jacket 392 may be controlled according to one or more of the methods of the present disclosure. In some embodiments, the heating provided by the heating jacket 392 may be controlled according to one or more of the processes described in the co-pending, co-owned and related application titled "System and Method for Thermal-Visual Servoing," Ser. No. 17/845,668, referenced above.

In some embodiments, the pressure plate 390 may be segmented into discrete sections. In an example, a discrete section corresponds to one or more cells 835 (FIG. 8C) that correspond to an individual drying zone or a group of individual drying zones. One or more discrete sections of the pressure plate 390 may be heated by a discrete heating element or discrete heating jacket. Furthermore, control of the heating of one or more discrete sections of the pressure plate 390 may be independent of the control of the heating of one or more other discrete sections of the pressure plate 390. In some embodiments, the heating of one or more discrete sections of the pressure plate 390 may be controlled according to one or more of the methods of the present disclosure. In some embodiments, the heating of one or more discrete sections of the pressure plate 390 may be controlled according to one or more of the processes described in the co-pending, co-owned and related application titled "System and Method for Thermal-Visual Servoing," Ser. No. 17/845,668, referenced above.

In some embodiments, such as in one or more embodiments in which a garment to be dried and/or pressed is positioned on a platen 405 (such as shown in FIGS. 6A-6F), the platen 405 functions as a lower pressure plate, and the pressure plate 390 functions as an upper pressure plate. For example, the lift 145 (FIGS. 6A-6C) may apply an upward force to the platen 405 upon which the garment is located such that the garment is squeezed between and by the platen 405 and the pressure plate 390. In another example, gravity and/or a mechanism (such as a robotic arm, a piston, a chain drive, a belt drive, a gear system, or the like) causes the pressure plate 390 to apply a downward force such that the garment is squeezed between and by the platen 405 and the pressure plate 390. In some embodiments, movement of the pressure plate 390 is controlled by a controller, such as the primary controller 165, the secondary controller 170, the dryer controller 370, and/or a local controller 375, described above. In some embodiments, the application of force by the pressure plate 390 is controlled by a controller, such as the primary controller 165, the secondary controller 170, the dryer controller 370, and/or a local controller 375, described above.

In some embodiments, the dryer 300A is movable, such as in a vertical direction, in order to adjust the distance between the dryer 300A and a garment being dried and/or pressed. In some embodiments, the dryer 300A is movable, such as in a vertical direction, in order to position the pressure plate 390 onto a garment being dried and/or pressed and to apply a pressure to the garment being dried and/or pressed. In some embodiments, the dryer 300A is moved by a mechanism such as a robotic arm, a piston, a chain drive, a belt drive, a gear system, or the like. In some embodiments, movement of the dryer 300A is controlled by a controller, such as the primary controller 165, the secondary controller 170, the dryer controller 370, and/or a local controller 375, described above.

Figure 10:
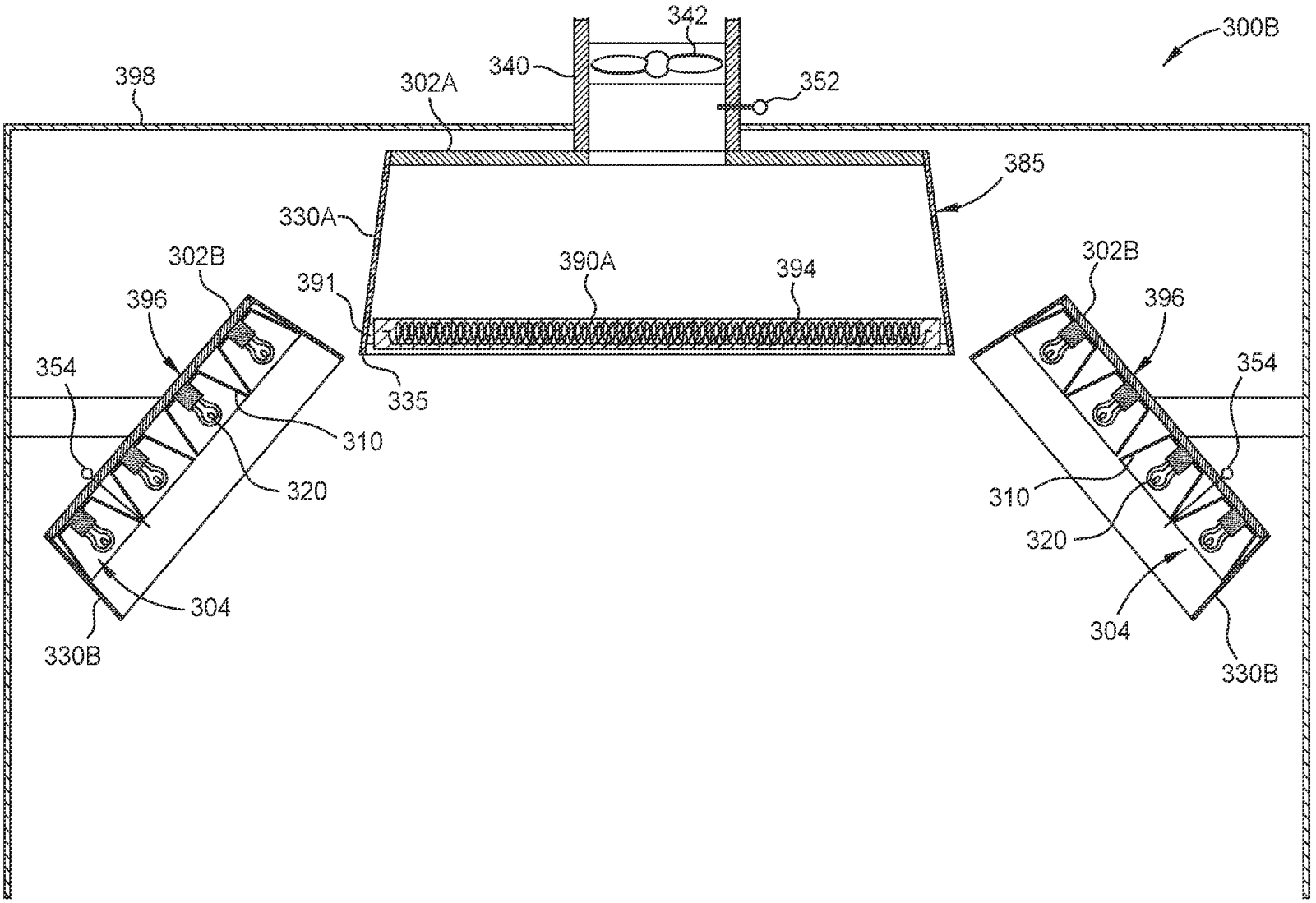
FIG. 10 schematically illustrates another dryer that may be used in place of the dryer illustrated in FIGS. 3A-3H.

FIG. 10 schematically illustrates in cross-section a dryer 300B that may be used in place of dryer 300 or dryer 300A when performing one or more methods of the present disclosure. Dryer 300B includes features of dryer 300 and features of dryer 300A; components common to dryer 300B and at least one of dryer 300 or dryer 300A retain similar reference numerals. In some embodiments, operation of the dryer 300B is controlled by a controller, such as the primary controller 165, the secondary controller 170, the dryer controller 370, and/or one or more local controllers 375, described above. Dryer 300B includes a pressure plate assembly 385 and one or more bulb arrays 396.

The pressure plate assembly 385 includes a hood 302A. An exhaust vent 340 is coupled to the hood 302A. A fan 342 disposed in the exhaust vent 340 is configured to draw air through the hood 302A, and expel the air through the exhaust vent 340. One or more sensors 352 disposed in the exhaust vent 340 are configured to measure one or more parameters related to the garment being dried by the dryer 300B, such as one or more parameters of the air in the exhaust vent 340. In an example, the one or more sensors 352 are configured to measure any one or more of temperature, pressure, flow rate, or humidity. In another example, the one or more sensors 352 include an optical or IR sensor configured to measure a quantity of one or more chemicals present in the air, such as carbon dioxide, carbon monoxide, nitrogen oxides, and/or volatile organic compounds. In another example, the one or more sensors 352 include a particle sensor, such as an optical or IR sensor, configured to measure a quantity of particulate material present in the air. In some embodiments, the one or more sensors 352 are configured to measure a combination of any two or more of the above parameters. In some embodiments, data from the one or more sensors 352 is used in controlling the operation of the dryer 300 by performing one or more of the methods described in the present disclosure. In some embodiments, data from the one or more sensors 352 is used in controlling the operation of the dryer 300 by performing one or more of the methods described in the co-pending and co-owned application titled "System and Method for Thermal-Visual Servoing," Ser. No. 17/845,668, referenced above.

The dryer 300B includes a pressure plate 390A coupled to the hood 302A. As illustrated, in some embodiments the pressure plate 390A is coupled to a shroud 330A of the hood 302A via one or more brackets 391. The coupling with the brackets 391 enables air to flow into the hood 302A from below the pressure plate 390A, such as in between adjacent brackets 291. As illustrated, in some embodiments, the pressure plate 390A is mounted within the shroud 330A. Alternatively, the pressure plate 390A may be mounted below the lower end 335 of the shroud 330A. Alternatively, the pressure plate 390A may be mounted partially within the shroud 330A and protruding below the lower end 335 of the shroud 330A.

In some embodiments, the pressure plate 390A includes a metal material, such as a steel or aluminum. In some embodiments, a surface of the pressure plate 390A that faces a garment being dried and/or pressed is configured to resist the transfer of ink and/or dye from the garment to the pressure plate 390A. In an example, the surface may include a coating of a non-stick material, such as PTFE. In some embodiments, a barrier sheet may be interposed between the pressure plate 390A and the garment being dried and/or pressed in order to hinder the transfer of ink and/or dye from the garment to the pressure plate 390A. In some of such embodiments, the barrier is present when pressure is applied to the garment via the pressure plate 390A, and is absent when pressure is not applied to the garment via the pressure plate 390A. In some embodiments, the barrier is present when pressure is applied to the garment via the pressure plate 390A, and when pressure is not applied to the garment via the pressure plate 390A. In some embodiments, the barrier includes a material that is substantially transparent to infrared radiation, as described above. In some embodiments, the barrier includes a paper-based material.

In some embodiments, the pressure plate 390A may be heated. As illustrated, in some embodiments, the pressure plate 390A is heated by a heating element 394, such as an electrical heating element, embedded within the pressure plate 390A. In some embodiments, the heating provided by the heating element 394 is controlled by a controller, such as the primary controller 165, the secondary controller 170, the dryer controller 370, and/or a local controller 375, described above. In some embodiments, the heating provided by the heating element 394 may be controlled according to one or more of the methods of the present disclosure. In some embodiments, the heating provided by the heating element 394 may be controlled according to one or more of the processes described in the co-pending, co-owned and related application titled "System and Method for Thermal-Visual Servoing," Ser. No. 17/845,668, referenced above.

In some embodiments, the pressure plate 390A may be segmented into discrete sections. In an example, a discrete section corresponds to one or more cells 835 (FIG. 8C) that correspond to an individual drying zone or a group of individual drying zones. One or more discrete sections of the pressure plate 390A may be heated by a discrete heating element or discrete heating jacket. Furthermore, control of the heating of one or more discrete sections of the pressure plate 390A may be independent of the control of the heating of one or more other discrete sections of the pressure plate 390A. In some embodiments, the heating of one or more discrete sections of the pressure plate 390A may be controlled according to one or more of the methods of the present disclosure. In some embodiments, the heating of one or more discrete sections of the pressure plate 390A may be controlled according to one or more of the processes described in the co-pending, co-owned and related application titled "System and Method for Thermal-Visual Servoing," Ser. No. 17/845,668, referenced above.

In some embodiments, such as in one or more embodiments in which a garment to be dried and/or pressed is positioned on a platen 405 (such as shown in FIGS. 6A-6F), the platen 405 functions as a lower pressure plate, and the pressure plate 390A functions as an upper pressure plate. For example, the lift 145 (FIGS. 6A-6C) may apply an upward force to the platen 405 upon which the garment is located such that the garment is squeezed between and by the platen 405 and the pressure plate 390A. In another example, gravity and/or a mechanism (such as a robotic arm, a piston, a chain drive, a belt drive, a gear system, or the like) causes the pressure plate 390A to apply a downward force such that the garment is squeezed between and by the platen 405 and the pressure plate 390A. In some embodiments, movement of the pressure plate 390A is controlled by a controller, such as the primary controller 165, the secondary controller 170, the dryer controller 370, and/or a local controller 375, described above. In some embodiments, the application of force by the pressure plate 390A is controlled by a controller, such as the primary controller 165, the secondary controller 170, the dryer controller 370, and/or a local controller 375, described above.

Each of the one or more bulb arrays 396 includes a hood 302B with a plurality of compartments 304. Each compartment 304 includes a reflector 310 that is configured to direct incident radiation, such as optical light, UV light, and/or IR light, towards a corresponding region, such as below the reflector 310. A heating bulb 320 is disposed in each compartment 304. In some embodiments, the heating bulb 320 is configured to emit IR radiation, such as long wave, medium wave, and/or short wave IR radiation. In some embodiments, the heating bulb 320 is configured to emit near IR radiation. As illustrated, in some embodiments, a shroud 330B circumscribes the reflectors 310, and extends below the reflectors 310. In some embodiments, the shroud 330B may not extend below the reflectors 310. In some embodiments, the shroud 330B may be omitted.

In some embodiments, each of the one or more bulb arrays 396 includes one or more configurations of reflectors 310 and heating bulbs 320 as described above with respect to any of FIGS. 3B-3D. In some embodiments, each of the one or more bulb arrays 396 is configured to provide one or more lighting configurations of reflectors 310 and heating bulbs 320 as described above with respect to FIGS. 3E and 3F. In some embodiments, the heating bulbs 320 of each of the one or more bulb arrays 396 may be controlled via one or more of the arrangements described above with respect to FIGS. 3G and 3H.

As with dryer 300 and dryer 300A, it should be noted that the numbers and arrangements of compartments 304 and heating bulbs 320 of dryer 300B depicted in the Figures are purely for illustrative purposes. For example, in some embodiments, the compartments 304 and heating bulbs 320 may be arranged such that each successive row of compartments 304 and heating bulbs 320 is offset from the previous row. Additionally, or alternatively, the compartments 304 and heating bulbs 320 may be arranged such that the heating bulbs 320 are more closely spaced in some areas of the hood 302B than in other areas of the hood 302B. In some embodiments, the arrangement of compartments 304 and heating bulbs 320 in one bulb array 396 is the same as the arrangement of compartments 304 and heating bulbs 320 in one bulb array 396 of the dryer 300B. However, in some embodiments, the arrangement of compartments 304 and heating bulbs 320 in one bulb array 396 differs from the arrangement of compartments 304 and heating bulbs 320 in another bulb array 396 of the dryer 300B.

In some embodiments, each bulb array 396 includes one or more sensors 354 are disposed in the hood 302B, and are configured to measure a parameter related to the garment being dried by the dryer 300B. In an example, the one or more sensors 354 include a thermal imaging camera configured to measure a temperature of a portion of the garment being dried. In another example, the one or more sensors 354 include a moisture sensor, such as an optical sensor, configured to measure a moisture content of air above a corresponding portion of the garment being dried. In another example, the one or more sensors 354 include a moisture sensor, such as an optical sensor or an IR moisture sensor, configured to measure a moisture content of a portion of the garment being dried. In some embodiments, a plurality of sensors 354 is disposed in the hood 302, the plurality of sensors 354 including one or more sensors 354 configured to measure one of the above parameters, and including one or more sensors 354 configured to measure a different one of the above parameters. In some embodiments, data from the one or more sensors 354 is used in controlling the operation of the dryer 300 by performing one or more of the methods described in the present disclosure. In some embodiments, data from the one or more sensors 354 is used in controlling the operation of the dryer 300 by performing one or more of the methods described in the co-pending and co-owned application titled "System and Method for Thermal-Visual Servoing," Ser. No. 17/845,668, referenced above.

In some embodiments, a bulb array 396 is positioned such that a garment to be dried and/or pressed is heated from above. In some embodiments, a bulb array 396 is positioned such that a garment to be dried and/or pressed is heated from one or more sides. In some embodiments, a bulb array 396 is positioned such that a garment to be dried and/or pressed is heated from below. In an example, a bulb array 396 may heat a garment positioned at the dryer 300B on a platen 405 (FIGS. 6A-6C) from below. For instance, the platen 405 may include a material that is substantially transparent to infrared radiation, as described above, may include apertures through which the radiation from the heating bulbs 320 passes, and/or may itself be heated by the radiation from the heating bulbs 320. In an additional or alternative example, at least a portion of the radiation from the heating bulbs 320 may be reflected onto the garment by a surface, such as the pressure plate 390A.

As illustrated, in some embodiments, the pressure plate assembly 285 and each bulb array 396 are coupled to a frame 398. In some embodiments, the pressure plate assembly 285 is movable, such as in a vertical direction, in order to adjust the distance between the pressure plate assembly 285 and a garment being dried and/or pressed. In some embodiments, the pressure plate assembly 285 is movable, such as in a vertical direction, in order to position the pressure plate 390A onto a garment being dried and/or pressed and to apply a pressure to the garment being dried and/or pressed. In some embodiments, the pressure plate assembly 285 is moved by a mechanism such as a robotic arm, a piston, a chain drive, a belt drive, a gear system, or the like. In some embodiments, each bulb array 396 is movable with respect to the pressure plate assembly 285, such as in a vertical direction, a horizontal direction, or a rotational direction. In some embodiments, each bulb array 396 is moved by a mechanism such as a robotic arm, a piston, a chain drive, a belt drive, a gear system, or the like. In some embodiments, movement of the pressure plate assembly 285 and/or each bulb array 396 is controlled by a controller, such as the primary controller 165, the secondary controller 170, the dryer controller 370, and/or a local controller 375, described above.

Figure 11:
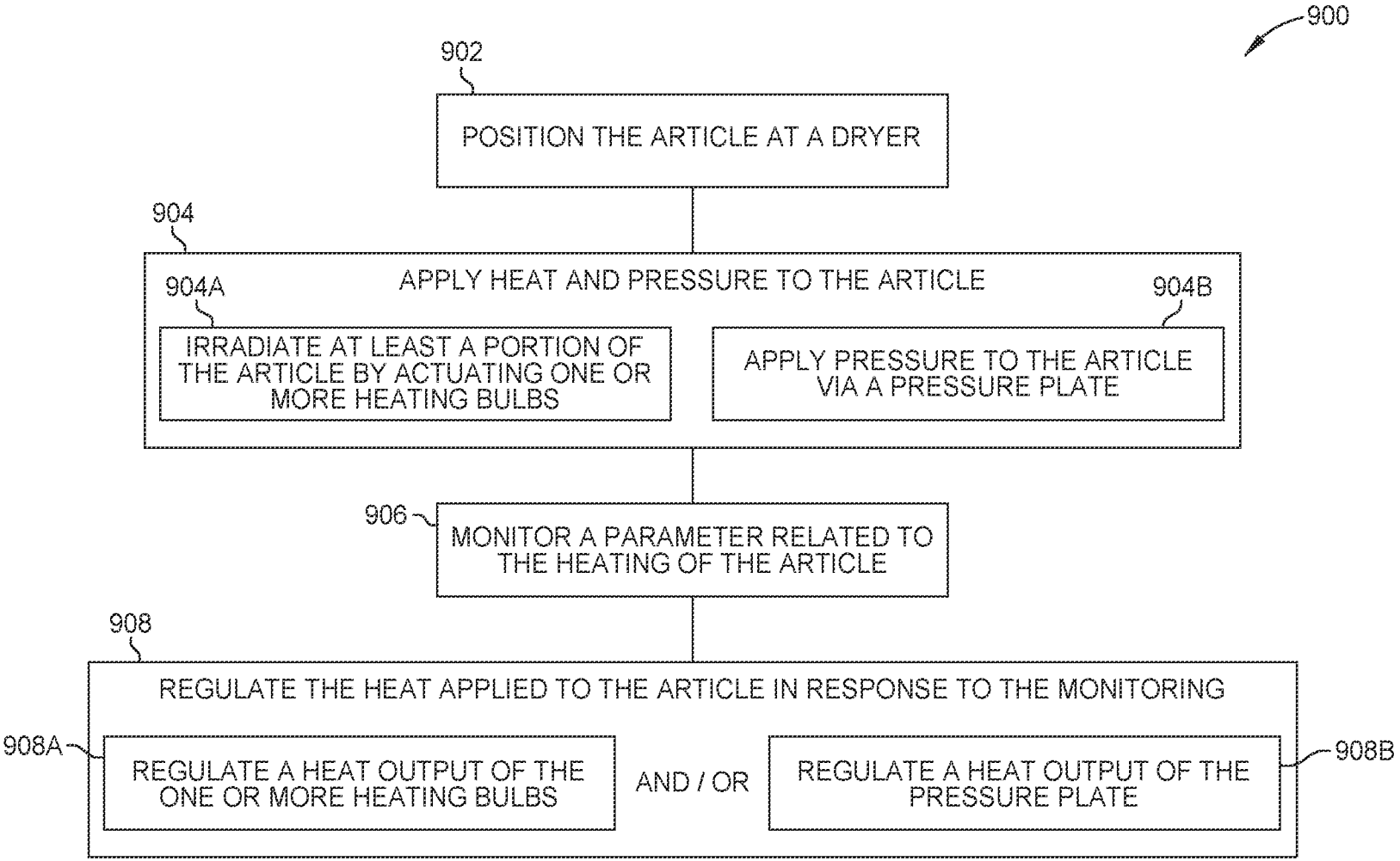
FIG. 11 is a flow chart for performing a drying or curing operation.

FIG. 11 is a flow chart of a method 900 for drying an article and/or curing ink applied to an article, such as garment 120 or article 800, or any other item described above. The method 900 may be conducted using the dryer 300A or the dryer 300B. In some embodiments, one or more of the operations of method 900 may be controlled by one or more controller, such as the primary controller 165, the secondary controller 170, the dryer controller 370, and/or a local controller 375. At operation 902, the article is positioned at a dryer. In some embodiments, the positioning is performed according to any of the methods described above. At operation 904, heat and pressure are applied to the article.

Operation 904 includes two sub-operations, 904A and 904B. At operation 904A, at least a portion of the article is irradiated by one or more heating bulbs, such as one or more heating bulbs 320, as described above. At operation 904B, pressure is applied to the article via a pressure plate, such as pressure plate 390 or pressure plate 390A. In some embodiments, the magnitude of pressure applied to the article may be controlled by one or more controller, such as the primary controller 165, the secondary controller 170, the dryer controller 370, and/or a local controller 375. In some embodiments, operation 904A is conducted prior to operation 904B. In some embodiments, such as operations involving dryer 300A, operation 904A is conducted simultaneously with operation 904B. For example, pressure may be applied to the article via the pressure plate 390 while the heating bulbs irradiate at least a portion of the article through the substantially IR-transparent material of the pressure plate 390. In some embodiments, the pressure plate 390 is heated by heating jacket 392 before and/or during the application of pressure to the article. In some embodiments, operation 904A is conducted after operation 904B.

In some embodiments, operation 904 includes a single execution of operation 904A and a single execution of operation 904B. In some embodiments, operation 904 includes a single execution of operation 904A and multiple executions of operation 904B. In some embodiments, operation 904 includes multiple executions of operation 904A and a single execution of operation 904B. In some embodiments, operation 904 includes multiple executions of operation 904A and multiple operations of operation 904B.

In an example, such as in operations involving dryer 300B, operation 904 may include the following sequence: perform operation 904A without operation 904B; then perform operation 904B without operation 904A; then perform operation 904A without operation 904B. In another example, the foregoing sequence may include a second performance of operation 904B after the second performance of operation 904A. In a further example involving dryer 300B, each bulb array 396 may be switched off while performing operation 904B, promoting energy efficiency.

In some embodiments, the pressure plate 390 or 390A may be heated by heating jacket 392 or heating element 394 while pressure is being applied to the article. In some embodiments, a first region of the pressure plate 390 or 390A may be operated at a first temperature, and a second region of the pressure plate 390 or 390A may be operated at a second temperature different to the first temperature. In some embodiments, the pressure plate 390 or 390A is heated to a temperature lower than a temperature of the article resulting from heating by the one or more heating bulbs 320. In some embodiments, the pressure plate 390 or 390A is heated to a temperature equal to a temperature of the article resulting from heating by the one or more heating bulbs 320. In some embodiments, the pressure plate 390 or 390A is heated to a temperature greater than a temperature of the article resulting from heating by the one or more heating bulbs 320. In an example involving dryer 300B, the pressure plate 390A is heated to a temperature lower than a temperature of the article resulting from heating by the one or more heating bulbs 320. The temperature of the pressure plate 390A is selected to be suitable for drying different materials, including fragile textiles that burn easily. Such a selection alleviates the need to wait for the pressure plate 390A to cool down between drying operations conducted on articles made from different textiles.

In some embodiments, a sequence of performing operation 904A at least partially prior to performing operation 904B enables ink or pretreatment solution on the article to at least partially cure, or dry, before applying pressure to the article using the pressure plate 390 or 390A. Such a sequence may inhibit unwanted transfer of ink or pretreatment solution to the pressure plate 390 or 390A, yet still promote the flattening of fibers of the article by the pressure plate 390 or 390A. In some embodiments, heating the pressure plate 390 or 390A to a temperature lower than a temperature of the article resulting from heating by the one or more heating bulbs 320 may inhibit unwanted transfer of ink or pretreatment solution to the pressure plate 390 or 390A, yet still promote the flattening of fibers of the article by the pressure plate 390 or 390A.

In some embodiments, the pressure applied to the article by the pressure plate 390 or 390A is created by the mechanism that moves the dryer 300A or pressure plate assembly 285. In some embodiments, the pressure applied to the article by the pressure plate 390 or 390A is created by the mechanism, such as the lift 145, that moves the article up to the dryer 300A or pressure plate assembly 285. In some embodiments, the pressure applied to the article by the pressure plate 390 or 390A is created by a combination of the mechanism that moves the dryer 300A or pressure plate assembly 285, and the mechanism, such as the lift 145, that moves the article up to the dryer 300A or pressure plate assembly 285.

At operation 906, one or more parameters related to the heating of the article are monitored. The monitoring is conducted according to any one or more of the methods described herein. In some embodiments, the monitoring includes acquiring data from the one or more sensors 352. In some embodiments, the monitoring includes acquiring data from the one or more sensors 354. In some embodiments, the monitoring includes acquiring data from the one or more sensors 352 and from the one or more sensors 354. In some embodiments, the monitoring is conducted simultaneously with the execution of operation 904A. In some embodiments, the monitoring is conducted simultaneously with the execution of operation 904B. In some embodiments, the monitoring is conducted prior to and following the execution of operation 904A. In some embodiments, the monitoring is conducted prior to and after the execution of operation 904B. In an example, one or more parameters are monitored prior to applying pressure to the article via the pressure plate 390 or 390A, then pressure is applied via the pressure plate 390 or 390A, then the applied pressure is released, then the one or more parameters are monitored to identify the new value(s) of the one or more parameters.

At operation 908, the heat applied to the article is regulated in response to the monitoring. Operation 908 includes at least one of sub-operation 908A or sub-operation 908B. At sub-operation 908A, a heat output of the one or more heating bulbs is regulated, such as by any one of the methods or processes disclosed herein. At sub-operation 908B, a heat output of the pressure plate 390 or 390A is regulated. In some embodiments, the heat output of the pressure plate 390 or 390A is increased. In some embodiments, the heat output of the pressure plate 390 or 390A is decreased. In some embodiments the heat output of a first region of the pressure plate 390 or 390A is adjusted independently of the heat output of a second region of the pressure plate 390 or 390A. In some embodiments, operation 908 includes sub-operation 908A, but does not include sub-operation 908B. In some embodiments, operation 908 includes sub-operation 908B, but does not include sub-operation 908A. In some embodiments, operation 908 includes sub-operation 908A and sub-operation 908B.

In some embodiments, one or more aspects of operation 908 are conducted simultaneously with one or more aspects of operation 904. In some embodiments, one or more aspects of operation 908 are conducted simultaneously with one or more aspects of operation 906. In some embodiments, one or more aspects of operation 908 are conducted simultaneously with one or more aspects of operation 904 and simultaneously with one or more aspects of operation 906.

The systems and methods of the present disclosure provide for the controlled and automated drying of an article and drying/curing of ink applied to an article. The drying/curing regime may be tailored to a specific article in order to benefit manufacturing plant throughput, energy efficiency, and consistent quality control of finished products.

In the current disclosure, reference is made to various embodiments. However, it should be understood that the present disclosure is not limited to specific described embodiments. Instead, any combination of the following features and elements, whether related to different embodiments or not, is contemplated to implement and practice the teachings provided herein. Additionally, when elements of the embodiments are described in the form of "at least one of A and B," it will be understood that embodiments including element A exclusively, including element B exclusively, and including element A and B are each contemplated. Furthermore, although some embodiments may achieve advantages over other possible solutions or over the prior art, whether or not a particular advantage is achieved by a given embodiment is not limiting of the present disclosure. Thus, the aspects, features, embodiments and advantages disclosed herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

As will be appreciated by one skilled in the art, embodiments described herein may be embodied as a system, method or computer program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments described herein may take the form of a computer program product embodied in one or more computer readable medium(s) having computer readable program code embodied thereon.

Program code embodied on a computer readable medium may be transmitted using any appropriate medium, including but not limited to wireless, wireline, optical fiber cable, RF, etc., or any suitable combination of the foregoing.

Computer program code for carrying out operations for embodiments of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described herein with reference to flowchart illustrations or block diagrams of methods, apparatuses (systems), and computer program products according to embodiments of the present disclosure. It will be understood that each block of the flowchart illustrations or block diagrams, and combinations of blocks in the flowchart illustrations or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the block(s) of the flowchart illustrations or block diagrams.

These computer program instructions may also be stored in a computer readable medium that can direct a computer, other programmable data processing apparatus, or other device to function in a particular manner, such that the instructions stored in the computer readable medium produce an article of manufacture including instructions which implement the function/act specified in the block(s) of the flowchart illustrations or block diagrams.

The computer program instructions may also be loaded onto a computer, other programmable data processing apparatus, or other device to cause a series of operational steps to be performed on the computer, other programmable apparatus or other device to produce a computer implemented process such that the instructions which execute on the computer, other programmable data processing apparatus, or other device provide processes for implementing the functions/acts specified in the block(s) of the flowchart illustrations or block diagrams.

The flowchart illustrations and block diagrams in the Figures illustrate the architecture, functionality, and operation of possible implementations of systems, methods, and computer program products according to various embodiments of the present disclosure. In this regard, each block in the flowchart illustrations or block diagrams may represent a module, segment, or portion of code, which comprises one or more executable instructions for implementing the specified logical function(s). It should also be noted that, in some alternative implementations, the functions noted in the block may occur out of the order noted in the Figures. For example, two blocks shown in succession may, in fact, be executed substantially concurrently, or the blocks may sometimes be executed in the reverse order or out of order, depending upon the functionality involved. It will also be noted that each block of the block diagrams or flowchart illustrations, and combinations of blocks in the block diagrams or flowchart illustrations, can be implemented by special purpose hardware-based systems that perform the specified functions or acts, or combinations of special purpose hardware and computer instructions.

It is contemplated that elements and features of any one disclosed embodiment may be beneficially incorporated in one or more other embodiments. While the foregoing is directed to embodiments of the present disclosure, other and further embodiments of the disclosure may be devised without departing from the basic scope thereof, and the scope thereof is determined by the claims that follow.

What is claimed is:

1. A method of heating and pressing an article comprising:
- positioning an article at a dryer;
- irradiating at least a portion of the article by actuating one or more heating bulbs of the dryer;
- applying pressure to the article via a pressure plate of the dryer, wherein irradiating the portion of the article is performed after applying pressure to the article via the pressure plate;
- monitoring a parameter related to heating the portion of the article; and
- regulating a heat output of the one or more heating bulbs in response to monitoring the parameter.

2. The method of claim 1, wherein irradiating the portion of the article is performed simultaneously with applying pressure to the article via the pressure plate.

3. The method of claim 2, wherein the irradiating of the portion of the article is performed by directing infrared radiation through the pressure plate.

4. The method of claim 1, wherein monitoring a parameter related to heating of the portion of the article comprises detecting a temperature of a section of the article.

5. The method of claim 1, wherein monitoring a parameter related to heating of the portion of the article comprises detecting a moisture content of air above a corresponding section of the article.

6. The method of claim 1, wherein monitoring a parameter related to heating of the portion of the article comprises detecting a moisture content of a section of the article.

7. The method of claim 1, wherein monitoring a parameter related to heating of the portion of the article comprises detecting, in air being expelled from the dryer, a presence of at least one of particulate matter or a volatile compound.

8. The method of claim 1, further comprising regulating the heat output of the one or more heating bulbs independently of other heating bulbs of the dryer.

9. A drying apparatus comprising:
- a hood including a plurality of compartments, each compartment including a reflector, each reflector configured to direct incident radiation towards a corresponding region below the reflector;
- a plurality of heating bulbs configured to emit short wave infrared radiation, each heating bulb disposed in a corresponding compartment of the plurality of compartments;
- an exhaust vent coupled to the hood;
- a fan disposed in the exhaust vent;
- a shroud circumscribing the compartments and extending below the reflectors;
- a sensor configured to measure a parameter related to heating of at least a portion of an article located below the hood; and
- a pressure plate disposed below the plurality of heating bulbs.

10. The drying apparatus of claim 9, wherein the pressure plate is substantially transparent to infrared radiation.

11. The drying apparatus of claim 10, further comprising a heater coupled to the pressure plate.

12. The drying apparatus of claim 9, further comprising a controller configured to receive data from the sensor, and to use the data to regulate operation of each heating bulb independently of other heating bulbs of the plurality of heating bulbs.

13. The drying apparatus of claim 9, wherein the sensor is selected from a group consisting of a thermal imaging camera, a moisture sensor, a particle sensor, or a sensor configured to measure a quantity of one or more chemicals present in air.

14. A drying apparatus comprising:
- a pressure plate assembly, comprising:
  - a first hood;
  - an exhaust vent coupled to the first hood;
  - a fan disposed in the exhaust vent;
  - a sensor configured to measure a parameter related to heating of at least a portion of an article located below the first hood; and
  - a pressure plate coupled to the first hood and disposed below the exhaust vent; and
- a bulb array comprising:
  - a second hood including a plurality of compartments, each compartment including a reflector;
  - a shroud circumscribing the compartments and extending below the reflectors; and
  - a plurality of heating bulbs configured to emit short wave infrared radiation, each heating bulb disposed in a corresponding compartment of the plurality of compartments.

15. The drying apparatus of claim 14, further comprising a heater coupled to the pressure plate.

16. The drying apparatus of claim 14, wherein the bulb array is movable with respect to the pressure plate assembly.

17. The drying apparatus of claim 14, further comprising a frame coupled to the pressure plate assembly and coupled to the bulb array.

18. The drying apparatus of claim 14, wherein the sensor includes a particle sensor or a sensor configured to measure a quantity of one or more chemicals present in air.

* * * * *